US006077468A

United States Patent [19]

Jariwala et al.

[11] Patent Number: 6,077,468

[45] Date of Patent: Jun. 20, 2000

[54] PROCESS OF DRAWING FIBERS

[75] Inventors: Chetan P. Jariwala, Woodbury, Minn.; Edward R. Hauser, St. Joseph, Wis.; James E. Lockridge, Woodbury, Minn.; Irvin F. Dunsmore, Ham Lake, Minn.; Malcolm B. Burleigh, St. Paul, Minn.; Nicole L. Franchina, Afton, Minn.

[73] Assignee: 3M Innovative Properties Company, St. Paul, Minn.

[21] Appl. No.: 09/228,466

[22] Filed: Jan. 11, 1999

[51] Int. Cl.[7] ..... D06M 13/17; D06M 13/213

[52] U.S. Cl. ..... 264/103; 264/129; 264/130; 264/210.3; 264/210.8; 264/211.14

[58] Field of Search ..... 264/103, 129, 264/130, 210.3, 210.8, 211.14

[56] References Cited

U.S. PATENT DOCUMENTS

| | | | |
|---|---|---|---|
| 1,681,745 | 8/1928 | Pohl | 106/268 |
| 2,876,140 | 3/1959 | Sheehan | 117/139.5 |
| 3,704,160 | 11/1972 | Steinmiller | 117/138.8 |
| 3,770,861 | 11/1973 | Hirano et al. | 264/130 |
| 4,066,558 | 1/1978 | Shay et al. | 252/8.9 |
| 4,076,631 | 2/1978 | Caruso et al. | 252/8.8 |
| 4,144,026 | 3/1979 | Keller et al. | 8/115.6 |
| 4,153,561 | 5/1979 | Hummuller et al. | 252/8.75 |
| 4,264,484 | 4/1981 | Patel | 260/29.6 |
| 4,329,390 | 5/1982 | Danner | 428/264 |
| 4,388,372 | 6/1983 | Champaneria et al. | 428/395 |
| 4,401,780 | 8/1983 | Steel | 524/225 |
| 4,504,401 | 3/1985 | Matsuo et al. | 252/8.75 |
| 4,566,981 | 1/1986 | Howells | 252/8.8 |
| 4,680,212 | 7/1987 | Blyth et al. | 428/97 |
| 4,822,373 | 4/1989 | Olson et al. | 8/115.6 |
| 4,833,188 | 5/1989 | Kortmann et al. | 524/217 |
| 4,839,212 | 6/1989 | Blyth et al. | 428/96 |
| 4,875,901 | 10/1989 | Payet et al. | 8/115.56 |
| 4,883,604 | 11/1989 | Veitenhansl et al. | 252/8.9 |
| 4,900,496 | 2/1990 | Andrews, Jr. et al. | 264/103 |
| 4,925,707 | 5/1990 | Vinod | 427/393.4 |
| 4,940,757 | 7/1990 | Moss, III et al. | 525/502 |
| 4,959,248 | 9/1990 | Oxenrider et al. | 427/385.5 |
| 5,015,259 | 5/1991 | Moss, III et al. | 8/115.6 |
| 5,025,052 | 6/1991 | Crater et al. | 524/104 |
| 5,057,121 | 10/1991 | Fitzgerald et al. | 8/133 |
| 5,061,763 | 10/1991 | Moss, III et al. | 525/502 |
| 5,073,442 | 12/1991 | Knowlton et al. | 428/267 |
| 5,084,306 | 1/1992 | McLellan et al. | 427/339.4 |
| 5,139,873 | 8/1992 | Rebouillat | 428/375 |
| 5,153,046 | 10/1992 | Murphy | 428/96 |
| 5,244,951 | 9/1993 | Gardiner | 524/168 |
| 5,246,988 | 9/1993 | Wincklhofer et al. | 524/86 |
| 5,252,232 | 10/1993 | Vinod | 252/8.6 |
| 5,260,406 | 11/1993 | Pechhold | 528/158 |
| 5,263,308 | 11/1993 | Lee et al. | 57/241 |
| 5,310,828 | 5/1994 | Williams | 252/502 |
| 5,370,804 | 12/1994 | Day | 252/41 |
| 5,399,616 | 3/1995 | Kuhn et al. | 524/765 |
| 5,403,426 | 4/1995 | Johnson et al. | 264/103 X |
| 5,408,010 | 4/1995 | May | 252/327.4 |
| 5,414,111 | 5/1995 | Kirchner | 560/357 |
| 5,464,911 | 11/1995 | Williams et al. | 525/502 |
| 5,491,004 | 2/1996 | Mudge et al. | 427/393.4 |
| 5,516,337 | 5/1996 | Nguyen | 8/557 |
| 5,520,962 | 5/1996 | Jones, Jr. | 427/393 |
| 5,565,607 | 10/1996 | Maekawa et al. | 560/223 |
| 5,567,400 | 10/1996 | Mudge et al. | 252/8.62 |
| 5,599,613 | 2/1997 | Smith | 252/8.62 |
| 5,738,687 | 4/1998 | Kamrath et al. | 8/115.56 |
| 5,756,181 | 5/1998 | Wang et al. | 428/96 |

FOREIGN PATENT DOCUMENTS

| | | |
|---|---|---|
| 353 080 | 7/1989 | European Pat. Off. . |
| 516 412 A2 | 5/1992 | European Pat. Off. . |
| 296515 | 10/1983 | Germany . |
| 6-057541 | 3/1994 | Japan . |
| 7-252727 | 10/1995 | Japan . |
| 2-572503 | 10/1996 | Japan . |
| 9-049167 | 2/1997 | Japan . |
| 1189581 | 4/1970 | United Kingdom . |
| 2 282 153 | 3/1995 | United Kingdom . |
| WO 91/04305 | 4/1991 | WIPO . |
| WO 92/10605 | 6/1992 | WIPO . |
| WO 93/19238 | 9/1993 | WIPO . |
| WO 97/06127 | 2/1997 | WIPO . |

OTHER PUBLICATIONS

Melliand Textilberichte–International Textile Reports English Edition vol. 6, No. 3 Mar., 1977 pp. 250–209.

Goulston Technologies, Inc. Specialists In Fiber Lubricants *Lubricants for Synthetic Fibers* Jul. 24, 1998.

*Lubricants for Fiber and Yarn Production* http://www.gem-san.com/english/textile–lubricants for fiber and yarn pr.htm (Updated).

*Spin Finishes for Synthetic Fibres–Part IV* Dr. N.B. Nevrekar & B.H. Palan, Sasmira, Man–Made Textiles In India (Sep. 1991).

Goulston Technologies, Inc. Specialists In Fiber Lubricants *Applying Spin Finishes For Optimum Downstream Fiber Quality* Aug. 18, 1998 http://www.onlinetextilenews.com/news/90345854915850.htm.

*Primary Examiner*—Leo B. Tentoni
*Attorney, Agent, or Firm*—John A. Fortkort

[57] ABSTRACT

A low melting, high solids spin finish composition is provided that can be readily applied to synthetic fibers during the fiber-making process. The spin finish solids, which make up at least about 70% by weight of the spin finish composition, comprise nonionic hydrocarbon surfactant components, such as polyoxyalkylenes, which have a <HLB> value of from about 2 to 13 and a melting point within the range of about 25° C. to about 140° C. In some embodiments, the spin finish composition also includes select fluorochemicals.

86 Claims, No Drawings

PROCESS OF DRAWING FIBERS

FIELD OF THE INVENTION

This invention relates to low melting, high solids spin finish compositions, a method for applying the compositions to fibrous substrates, and fibrous substrates treated with the high solids spin finish compositions.

BACKGROUND OF THE INVENTION

Lubrication and finishing of yarns and threads, such as cotton and silk, has been practiced since ancient times. Such yarns and threads, derived from natural-containing plants and animals such as cotton plants and silkworms, often required lubrication or finishing by "oiling" or "sizing" to facilitate spinning and bundling. Lubricants used were typically natural hydrophobic oils, such as mineral oil or coconut oil. Sometimes, molten waxes such as beeswax were employed which, when cooled, formed a solid lubricating finish. Usually, the fibers were "sized" by applying a lubricant and/or adhesive material to yarn or warp threads in a weaving operation to impart cohesion and lubricity. Historically, sizes have been hard coatings, applied neat and at a higher fiber add-on than spin finishes, and were often based on starch, wax, and other oleophilic materials. For example, U.S. Pat. No. 1,681,745 discloses a beeswax-based size for artificial silk (rayon) which is applied molten and solidifies quickly before the thread is wound up, thus assuring bundle cohesion and lubrication in all subsequent operations.

While sizes were useful in facilitating the spinning and bundling of fibers, their presence in finished articles was found to be undesirable. In particular, the oleophilic nature of the sizes was found to adversely effect the soil resistance of the finished article. Sizes also frequently compromised the appearance and handle of the article. Consequently, it became common practice to remove the size from a woven article after its manufacture by scouring the article in hot and/or detergent-containing water. In some instances, these sizes were also removed or reduced to acceptable levels as an inherent part of the dying process, as when the woven article is dyed through immersion in aqueous dye baths. However, this later methodology, in which the scouring and dying steps were effectively combined into a single process, also had its drawbacks. In particular, the presence of sizes in the dye bath frequently had adverse affects on the dying process, while also necessitating frequent replenishment of the dye solution.

After World War II, fibers were introduced which were made from synthetic polymers such as nylon, polyolefin, polyester and acrylic. These new high performance synthetic fibers required the use of special sizes called "spin finishes" during spinning and the subsequent fiber operations (e.g , bundling or sizing) required to produce the final woven article (e.g., fabric or carpet). The spin finish served several functions, including (1) reducing the friction developed as the synthetic fibers passed over metal and ceramic machinery surfaces, (2) imparting fiber-to-fiber lubricity, (3) minimizing electrical static charge buildup (a problem especially pronounced in the manufacture of woven articles from synthetic fibers), and, in some instances, (4) providing cohesion to the fiber In addition, with proper use of additives, spin finish compositions could be made that were stable to high temperatures and pressures, had a controllable viscosity under application conditions, were non-corrosive, and were relatively safe to both the workers and the environment. (See Pushpa, B. et al., "Spin Finishes," *Colourage,* Nov. 16–30, 1987 (17–26)). However, as with their sizing predecessors, the spin finishes had to be removed from the articles woven from the fibers, typically by scouring, to minimize soiling problems. See, e.g., U.S. Pat. No. 5,263,308 (Lee et al.), Col. 2, Lines 23–25.

The process of scouring, which is necessitated by the use of sizes and spin finishes, is very undesirable in that it is a tedious process which adds to manufacturing costs, while also posing water pollution problems and health concerns. See, e.g., U.S. Pat. No. 5,263,308 (Lee et al ), Col. 2, Lines 20–24. Accordingly, some attempts have been made to avoid the need for scouring by treating unscoured carpets with agents that improve the soil resistance, handle, and other characteristics of the unscoured carpet to levels acceptable for the intended end use. Thus, U.S. Pat. No. 5,756,181 (Wang et al.) and U.S. Pat. No. 5,738,687 (Kamrath et al.) describe the treatment of unscoured carpet with certain polycarboxylate salts to achieve desirable soil resistance and repellency characteristics. Similarly, U.S. Ser. No. 08/595,592 , now U.S. Pat. No. 5,908,663 (Wang et al.), describes the topical treatment of unscoured carpets with various inorganic agents such as silica to improve the soil resistance of the carpet. However, while these treatments work quite well for their intended purpose, they require the incorporation of additional steps and materials, thereby increasing the cost and complexity of the manufacturing process. There is thus a need in the art for a method for making carpets and other woven articles that avoids the need for scouring without necessitating the use of additional treatment steps or agents.

A further problem associated with the use of many conventional spin finishes arises during the manufacturing process itself. The vast majority of spin finishes for synthetic fibers are applied from solution or dispersion in water and/or solvent. Health and safety concerns make high solvent levels in the spin finish impractical unless the solvent is non-toxic, non-flammable, and environmentally neutral. As a practical matter, this has limited the solvent selection to water. Also, aqueous dispersions of spin finishes have been preferred to neat spin finishes because the larger volume of finish applied per fiber weight results in lower application variability. Additionally, the water helps eliminate troublesome static charge, especially when formulated with other additives. (See Postman, W., "Spin Finishes Explained," *Textile Research Journal,* July 1980 (444–453).

Several examples of aqueous spin finish compositions are known to the art. Thus, U.S. Pat. No. 5,153,046 (Murphy) describes an aqueous finish composition for imparting soil-resistant protection to textile fibers, e.g., nylon yarn, which is stable to the high shear environment of a fiber finish application system. This composition is composed of 1–35% (weight) of nonionic fluorochemical textile anti-soilant, 65–95% of nonionic water-soluble or water-emulsifiable lubricant, and 0.05–15% each of quaternary ammonium or protonated amine surfactant and nonionic surfactant. Preferred lubricants are polyethylene glycol 600 monolaurate and methoxypolyethylene glycol 400 monopelargooiate.

U.S. Pat. No. 4,388,372 (Champaneria et al.) describes an improved process for making soil-resistant filaments of a synthetic linear polycarbonamide, preferably 6-nylon and 66-nylon, by applying a water-borne primary spin finish composition comprising a perfluoroalkyl ester, a modified epoxy resin and a non-ionic textile lubricant based on poly(ethylene glycol). Particularly preferred lubricants include n-butyl initiated random copolymers of ethylene/propylene oxide. At Col. 6, Lines 59–61 of the reference, it is noted that "Excessive amounts of textile lubricants in the finish composition can interfere in the durability and effectiveness of the soil-resistant ingredients." Accordingly, much of the lubricant is removed at a later stage of processing when the filaments are subjected to a scouring or dyeing operation (Col. 6, lines 51–55), and application of a secondary fiber finish composition to the spun yarn is recommended at the point between the take up and windup rolls (Col. 12, lines 18–19)

U.S. Pat. No. 4,883,604 (Veitenhansl et al.) describes compositions and methods for smoothing textile fibers and sheet-form textiles made from the fibers. These compositions, which are described as solutions, emulsions, or aqueous dispersions, contain a combination of aliphatic polyether having $C_6$–$C_{24}$ alkyl radicals and containing 1 to 25 units of polymerized $C_2$–$C_6$, alkylene oxides and oxidized, high-density polyethylene. The concentration of aliphatic polyether in these compositions is from 5% to 30%, with the remainder of the composition being dispersants, softeners, other additives, and water. The compositions are used to improve stitching characteristics of the sheet-formed textiles, and no mention is made of improving soil-resistance or repellency.

U.S. Pat. No. 5,139,873 (Rebouillat) discloses aromatic polyamide fibers which are said to be highly processable and to have high modulus, improved surface frictional properties, scourability, deposition, fibrillation and antistatic properties. The fibers have a coating consisting of (a) 30–70% by weight of a long chain carboxilic acid ester of a long chain branched primary or secondary, saturated, monohydric alcohol, (b) 20 to 50% by weight of an emulsifying system consisting of certain nonionic surfactants, with the remainder being an antistatic agent, a corrosion inhibitor or other optional additives. The scourability of the coating is said to be very important as the residual finish level impacts the subsequent finishing in the case of fabrics (Col. 11, Lines 52–56).

However, the use of low solids aqueous dispersion spin finishes on synthetic fibers has certain disadvantages Since water possesses a high heat of vaporization, considerable energy is required to evaporate the large quantity of water delivered to the fiber with the spin finish. Furthermore, aqueous dispersions of spin finishes can cause mechanical problems with the fiber line. For example, when conventional low solids aqueous spin finish dispersions are used, the liquid volume of spin finish required during application is fairly large, and this large volume can form non-uniform oily deposits or residues on godets, guides, winders, and other mechanical parts of the fiber-making machinery. These deposits, commonly known as "sling off", either drop to the factory floor or are thrown from the fiber or machinery at various points during the manufacturing process. Sling-off is highly objectionable to fiber manufacturers, due to the cost of clean-up, the damage it can cause to fiber making machinery, and the downtime associated with these problems.

Solid deposition is another major problem which can occur during production, especially when the fiber lubricant is a solid at room temperature and is applied at low solids from an aqueous dispersion. Solid deposition causes a build-up of solids on guides, rolls, and surfaces near the fiber line. The deposition problem is frequently exacerbated by the use of high viscosity spin finishes, the presence of repellent fluorochemicals in the spin finish composition, or the use of spin finish dispersions which go through a gel stage as the water evaporates from the fiber during drying. If the resulting solids are not periodically removed, they will cause fiber breaks. Unfortunately for the fiber manufacturer, the removal of solid depositions is a tedious, expensive and time-consuming process which requires a significant amount of downtime. There is thus a need in the art for spin finish compositions which provide good lubricity and other desirable spin finish characteristics, without exhibiting sling-off or solids deposition during the fiber manufacturing process Some attempts have been made to address the problems associated with aqueous spin finish dispersions. In particular, some neat spin finishes have been developed which are solid at room temperature but which can be applied to the fiber in a molten state at elevated temperatures.

U.S. Pat, No. 5,370,804 (Day) describes a neat lubricating finish composition comprising a natural or synthetic ester lubricant and an alkali metal salt of an aliphatic monocarboxylic acid having at least 8 carbon atoms, which melts at temperatures below 150° C. to form a low viscosity liquid to allow uniform coating of the fibers.

U.S. Pat. No. 4,066,558 (Shay et al.) describes a neat, stable yarn lubricating composition having a viscosity of 35–65 centipoise, consisting essentially of a hydrophobic alkyl stearate lubricant, a hydrophilic alcohol ethoxylate or alkylphenol ethoxylate, an antistat and 0.1–5% of a polar coupling agent, such as water, alcohol or glycol ether.

U.S. Pat. No. 3,704,160 (Steinmiller) describes a neat secondary finish comprising oil carrier, metallic fatty acid soap, and tri-fatty acid ester which is a hard waxy material at ambient temperature but, when heated to the molten state (i.e., heated to 50–80° C.), is suitable for treating yarn which is used downstream to make rope having desirable frictional properties for load sharing.

U.S. Pat. No. 4,900,496 (Andrews, Jr. et al.) describes a process for making tire cord made from polyamide yarn by applying a neat hydrophobic organic ester dip penetration regulator having a melting point above 27° C.

U.S. Pat. No. 5,567,400 (Mudge et al.) describes a method for applying a low soil finish to spun synthetic textile fibers containing a dry, waxy solid component solid at room temperature comprising (a) a polyethylenimine bisamide, (b) a block copolymer or ethylene oxide and propylene oxide, (c) the reaction product of a $C_{8-20}$ saturated fatty alcohol, a $C_{8-20}$ saturated fatty amine or a phenol with from 2 to 250 moles of ethylene oxide and/or (d) a $C_{8-20}$ fatty acid ester Japanese Published Application 6,057,541 describes a neat oil spin finish for synthetic fiber containing lubricant (e.g., butyl stearate or mineral oil), emulsifier and antistatic agent having a viscosity of less than 40 cps at 50° C.

Japanese Published Application 7,252,727 describes a high speed spinning manufacturing process wherein polyamide multifilamnent is cooled to solidification and a neat oil is applied containing sorbitan ester, polyoxyalkylene polyhydric alcohol, phosphate triethanolamine and antioxidant.

Japanese Published Application 9,049,167 describes the treatment of polyurethane elastic fiber with a neat-oiling agent comprising a mineral oil/polydimethylsiloxane lubricant and an alkanolamine organic phosphate to impart antistatic properties to the fiber between spinning and winding processes and to inhibit the adherence of scum onto the machine.

German Democratic Republic Published Application 296,515 describes a spin finish for synthetic filaments comprising alkylpoly-alkyleneglycol ether lubricants with 5–15% of a liquid dicarboxylic acid diester which may be applied as a neat oil.

U.S. Pat. No. 5,263,308 (Lee et al.) describes a method for ply-twisting nylon yarns (already spun) at high speeds by coating the nylon fibers with less than about 1% by weight of a finish containing an alkyl polyoxyethylene carboxylate ester lubricant composition of the general formula $R_1$—O—$X_n$—$(CH_2)_m$C(O)—O—$R_2$, where $R_1$ is an alkyl chain from 12 to 22 carbon atoms, X is —$C_2H_4O$— or a mixture of —$C_2H_4O$— and —$C_3H_6O$—, n is 3 to 7, m is 1 to 3, and $R_2$ is an alkyl chain from 1 to 3 carbon atoms. The resulting ply-twisted yarn is especially suitable for use as pile in carpets. The finish may be applied neat, although it is preferably applied from an aqueous solution or emulsion, and may be used as a primary or secondary spin finish. The reference notes that these lubricants, which are described as oils, are advantageous over other lubricants in that they may be applied at very low levels and afford ease of wash-off during dying or scouring operations, both of which lead to improved soiling repellency (see, e.g., Col. 5, Lines 10–36).

While some of the above approaches may avoid the problems of sling-off and solids deposition associated with many low solids formulations, many of these approaches also involve the use of spin finish formulations that detrimentally affect the soiling characteristics, appearance, or hand of the finished article. Consequently, the use of these formulations requires scouring, with all of the disadvantages attendant thereto. Accordingly, there remains a need in the art for a spin finish formulation that does not cause sling-off or solids deposition, while also avoiding the need for scouring of the finished article.

One possible approach to improving the soiling characteristics of articles woven from fibers containing a spin finish is to add fluorochemicals to the spin finish composition. Such spin finish compositions are known, though these compositions are typically low solids formulations. The relatively high cost of fluorochemicals relative to hydrocarbon surfactants has made it impractical to use fluorochemicals in high solids or neat spin finishes, as it would be very difficult to uniformly treat a fiber with a very low add-on level of a high solids or neat fluorochemical. Furthermore, many conventional fluorochemicals are insoluble in high solids or neat spin finish formulations.

One example of a low solids fluorochemical spin finish composition is described in U.S. Pat. No. 4,566,981 (Howells). This reference describes the treatment of fibrous substrates with mixtures or blends of (a) a mixture of cationic and non-ionic fluorochemicals, (b) a fluorochemical poly(oxyalkylene), and/or (c) a hydrocarbon nonionic surfactant, which may be a poly(oxyalkylene). The reference also teaches that the hydrocarbon surfactant has a hydrophilic/lipophilic balance (HLB) in the range of about 13 to 16, and notes that surfactants with HLB values outside of this range do not promote emulsion stability and quality. The reference indicates that the mixtures or blends disclosed therein may be applied to substrates such as carpets from a spin finish emulsion (see, e.g., Examples 44–46) to impart desirable oil and water repellency and soil resistance to the substrate. However, all of the emulsions described are low solids compositions.

Other fluorochemical fiber treatments have utilized fluorochemicals as polymer melt additives in resins to modify the surface properties of fibers extruded or spun from the resins and/or to reduce the amount of spin finish required to lubricate the fiber. Thus, U. S. Pat. No. 5,025,052 (Crater et al.) describes water- and oil-repellent fibers comprising a fiber-forming synthetic or organic polymer and a fluorochemical oxazolidinone.

U.S. Pat. No. 5,244,951 (Gardiner) describes a durably hydrophilic fiber comprising thermoplastic polymer and fluoroaliphatic group-containing non-ionic compound dispersed within said fiber and present at the surface of the fiber.

U.S. Ser. No. 08/808,491, now U.S. Pat. No. 5,882,762 (Goeman), describes a plurality of filaments of a thermoplastic polymer containing a fluorochemical hydrophilicity-imparting compound, allowing for reduced levels of spin oil fiber lubricant on the fiber to impart satisfactory lubricity.

European Application 97.2038 12.9 describes fiber spun from filaments extruded from a mixture of a hydrophilic polymer and a hydrophilicity imparting compound, wherein the filaments have applied to them prior to spinning a spin finish comprising a fluorochemical oil and/or water repellent.

Yet another problem with conventional spin finish formulations has come to light with the emergence of polypropylene as a staple fiber in the carpet industry. Most spin finishes produced to date were developed for use on the older nylon and acrylic fibers, which have little tendency to adsorb hydrocarbon materials. In contrast to these fibers, the surface of polypropylene fibers is much more oleophilic. As a result, many conventional spin finishes are adsorbed into the polypropylene fiber surface to a much greater degree than is observed with nylon or acrylic fibers. This frequently causes degradation of the fiber, while also necessitating the use of excessive amounts of spin finish to attain desired lubricity properties.

One approach to the spin finish adsorption problem has been to add fluorochemicals to the polypropylene melt prior to the time at which the fiber is extruded, thereby rendering the fiber less oleophilic. This approach is described in some of the references noted above. However, the addition of fluorochemicals to the melt is not always desirable in that it often has an adverse effect on the hand or other characteristics of the resulting fiber.

Some spin finishes for polypropylene fibers are known outside of the carpet art, although many of these are not primary spin finishes Thus, U.S. Pat. No. 5,246,988 (Wincklhofer et al.) describes the use of lubricants, which are the apparently liquid reaction products of 1 mole of either a $C_5$–$C_{36}$ fatty acid or alcohol with 2 to 20 moles of ethylene oxide, as carriers for hindered amine anti-oxidants. These anti-oxidants/carriers are used to treat articles of high molecular weight thermoplastic films and fibers, thereby rendering the articles stable to heat and aging and allowing them to retain their breaking strength. Preferably, the lubricant comprises polyalkylene glycol (400) perlargonate, polyalkylene glycol (200) monolaurate and/or polyalkylene glycol (600) monoisostearate. However, the reference teaches that these finishes must be applied subsequent to solvent extraction of the polymer (see, e.g., Col. 4, Lines 6–10), and hence teaches the use of these materials as secondary finishes.

There is thus a need in the art for spin finish compositions which avoid the above noted infirmities associated with conventional spin finishes, and which can be used as a primary spin finish to provide good lubricity to polypropylene fibers without significant absorption into the fiber surface.

These and other needs are met by the present invention, as hereinafter described.

SUMMARY OF THE INVENTION

In one aspect, the present invention relates to a low melting, high solids spin finish composition that can be readily applied as a primary spin finish to synthetic fibers during the fiber-making process. The spin finish solids consist essentially of nonionic hydrocarbon surfactant components, such as polyoxyalkylenes, which have a <HLB> value of from about 2 to 13.

In another aspect, the present invention relates to a method for applying the low melting, high solids spin finish composition as a primary spin finish to a synthetic fiber during the fiber-making process, thereby forming a treated fiber. In this method, the low melting, high solids spin finish composition is heated to a temperature above its melting point to form an oil. The oil is then applied to a synthetic fiber in a sufficient amount to provide lubrication to the fiber, allowing the fiber to move through the fiber-making equipment without binding of the fiber. By applying the low melting waxy solid as an oil at slightly elevated temperatures, roll build-up on the fiber machine is minimized and sometimes nearly eliminated, since the spin finish no longer undergoes the large viscosity increase upon drying which is encountered with low solids spin finish emulsions. Moreover, sling-off of spin finish from the treated fiber, a phenomenon frequently experienced with conventional spin finish compositions as the treated fiber moves rapidly through the fiber line, is drastically reduced. Soon after application, the oil re-solidifies on the fiber's surface to form a non-oily, non-tacky fiber finish which does not detract from the performance characteristics of the article made from the fiber. In the case of carpets made from fibers treated with the spin finish compositions of the present invention, for example, the soiling characteristics of the carpet are not detrimentally affected by the presence of the spin finish, and in fact, are often improved in comparison to carpets in which any residual spin finish has been removed (e.g., by scouring). As a result, it is not necessary to remove the spin finishes of the present invention from the final article of commerce, thereby eliminating the costly and potentially polluting scouring process typically used to remove spin finishes from carpets and other such fibrous articles. Surprisingly, it is found that many waxy hydrocarbon surfactants having relatively low HLB values impart superior soil-resistant properties to the fiber and articles made from the fiber In yet another aspect, this invention relates to articles made from synthetic fibers treated with the low melting, high solids spin finish composition.

The present invention also relates to a low melting, high solids, water- and oil-repellent spin finish composition that can be readily applied to synthetic fibers during the fiber-making process The solids component of this composition is a waxy material at ambient conditions having a melting point from about 25° to 140° C., and comprises a blend of(1) nonionic hydrocarbon surfactant component(s) having a <HLB> value of less than about 13, and (2) compatible fluorochemical(s) having a <FLB> value of less than 11. Such compatible fluorochemicals are found to form homogeneous solutions when blended at up to 50% by weight, preferably from about 10 to 15% by weight, with the hydrocarbon surfactant component(s) (i.e., no phase separation occurs) at typical operating temperatures. Typical operating temperatures are within the range of about 40–140° C., preferably about 80–120° C. The selection of a suitable compatible fluorochemical is not trivial, as most fluorochemicals are not compatible with hydrocarbon surfactants without the presence of external compatibilizers or without incorporating considerable amounts of solvent(s) and/or water. However, through considerable experimentation, it has been discovered that suitable compatible fluorochemicals can be selected based on a calculated quantity called fluorophilic/lipophilic balance (FLB) value. This new quantity, FLB value, is similar in concept to the HLB value for hydrocarbon surfactants, and can be calculated from the fluorochemical structure using Equation I:

$$FLB = \frac{\text{molecular weight of the fluorochemical segment(s)}^{*}}{\text{total molecular weight of the fluorochemical}} \times 20 \qquad \text{EQUATION I}$$

* includes all segments containing carbon-bonded fluorine atoms

To achieve compatibility between the fluorochemical(s) and hydrocarbon surfactant(s) in the absence of solvent (i.e., neat), the <FLB> value for the fluorochemical(s) should be less than 11.

When used in spin finish compositions of this invention, some compatible fluorochemicals directly impart oil- and water-repellent properties to the fiber and articles made from the fiber. Other compatible fluorochemicals, though alone not capable of imparting significant water- and oil-repellency to the spin finish, can be used as a solubilizer to incorporate otherwise incompatible fluorochemicals (such incompatible fluorochemicals hereinafter referred to as "repellent fluorochemicals"), which are known to be good water- and oil-repellents.

In another aspect, this invention relates to a method for applying the low melting, high solids, water- and oil-repellent spin finish composition to a synthetic fiber during the fiber-making process. In this method, the waxy solid is melted to form a high solids or neat oil, which is then applied to a synthetic fiber using heat traced conventional spin finish application equipment. Soon after application, the oily molten spin finish re-solidifies on the fiber's surface to form a non-oily, non-tacky fiber finish. This finish does not impart a deleterious effect to the articles woven from the fiber (i.e., worsen carpet soiling after foot trafficking). Thus, the costly and potentially polluting scouring process, typically used to remove the spin finish from the final woven article, is eliminated. The amount of spin finish composition applied to the fiber (% SOF, or percent solids on fiber) is an amount sufficient to allow the fiber to move easily over the polished metal and ceramic parts of the fiber-making machinery without binding of the fiber.

In yet another aspect, this invention relates to articles woven from synthetic fibers treated with the low melting, high solids spin finish composition.

In yet another aspect, this invention relates to a process for making water- and oil-repellent fibers and articles woven from such fibers comprising the steps of: (1) incorporating a repellent fluorochemical into a thermoplastic polymer melt, (2) extruding a fiber from the polymer melt, and (3) applying to the fiber a low melting, high solids spin finish composition consisting essentially of nonionic surfactant components having <HLB> values of from about 2 to 13.

In yet another aspect, the present invention relates to a spin finish for polypropylene fiber. The spin finish provides the required lubricity properties without being adsorbed to a significant degree by the fiber. The spin finish also exhibits excellent antisoiling characteristics, hand, and appearance when left on the fiber in the finished article, thereby avoiding the need for scouring.

In still another aspect, the present invention relates to a method for forming a high solids, shelf-stable spin finish composition In accordance with the method, water is added to an essentially neat polyoxyalkylene composition to form a high solids composition, with the proviso that the amount of water added is insufficient to cause the composition to turn cloudy. High solids compositions formed in this manner are found to have good shelf stability. By contrast, when the amount of water added is sufficient cause the high solids composition to turn cloudy, the resulting cloudy composition is found to exhibit poor shelf stability.

In another aspect, the present invention relates to a method for applying a spin finish composition containing a hydrocarbon surfactant and a fluorochemical emulsion to a fiber. In accordance with the method, the fluorochemical emulsion is metered or mixed into the spin finish composition and the combination quickly applied to the fiber when the fiber is ready to be spun. The method allows the blending together of a number of fluorochemical emulsions and hydrocarbon surfactants that have poor shelf stability, due, for example, to the incompatibility of these materials.

DETAILED DESCRIPTION

As used herein, the term "high solids" refers to a spin finish composition which contains from 70 to 100% spin finish solids and 30 to 0% solvent, the solvent typically being water. Thus, neat spin finish compositions (i.e., those containing essentially 0% solvent) are encompassed in this definition.

As used herein, the term "low melting" refers to a spin finish composition whose solids are often waxy to the touch at ambient conditions and have a melting point in the range of about 25° to 140° C.

As used herein, the term "primary spin finish" refers to a spin finish which is applied to synthetic fibers soon after they are extruded from the spinneret, cooled, and bundled, but prior to drawing.

As used herein, the term "HLB value" means the hydrophilic/lipophilic balance of the surfactant. The term "weighted average HLB value" (<HLB>) means the sum of the HLB values of each separate surfactant component multiplied by that component's percentage by weight in the spin finish composition solids.

As used herein, the term "FLB value" means the fluorochemical lipophilic balance of a fluorochemical. The FLB value can be calculated from the fluorochemical structure using Equation I:

$$FLB = \frac{\text{molecular weight of the fluorochemical segment(s)}^{*}}{\text{total molecular weight of the fluorochemical}} \times 20 \qquad \text{EQUATION I}$$

* includes all segments containing carbon-bonded fluorine atoms

The term "weighted average FLB value" (<FLB>) means the sum of the FLB values of each separate fluorochemical component multiplied by that component's percentage by weight in the spin finish composition solids.

As used herein, the term "compatible fluorochemical" refers to a fluorochemical with a <FLB> value of less than 11.

Thermoplastic polymers useful for making synthetic fibers of this invention include fiber-forming poly(alpha) olefins, polyamides, polyesters and acrylics. Preferred thermoplastic polymers are poly (alpha)olefins, including the normally solid, homo-, co- and terpolymers of aliphatic mono-1-olefins (alpha olefins) as they are generally recognized in the art. Usually, the monomers employed in making such poly(alpha)olefins contain 2 to 10 carbon atoms per molecule, although higher molecular weight monomers sometimes are used as comonomers. Blends of the polymers and copolymers prepared mechanically or in situ may also be used. Examples of monomers that can be employed in the invention include ethylene, propylene, butene-1, pentene-1, 4-methyl-pentene-1, hexene-1, and octene-1, alone, or in admixture, or in sequential polymerization systems. Examples of preferred thermoplastic poly(alpha)olefin polymers include polyethylene, polypropylene, propylene/ethylene copolymers, polybutylene and blends thereof. Polypropylene is particularly preferred for use in the invention.

Processes for preparing the polymers useful in this invention are well known, and the invention is not limited to a polymer made with a particular catalyst or process.

In accordance with the present invention, a molten thermoplastic polymer fiber can be extruded through a spinneret to form a plurality of filaments (typically around 80 filaments), each filament typically having a delta-shaped cross section The filaments are cooled, typically by passing through an air quenching apparatus maintained at or slightly below room temperature. The filaments are then bundled and directed across guides or kiss rolls, whereupon they are treated with a molten spin finish of this invention. After receiving the spin finish treatment, the filaments are generally stretched. Stretching may be accomplished over a number of godets or pull rolls that are at elevated temperatures (e.g., from 85–115° C.) sufficient to soften the thermoplastic polymer. By rotating the rolls at different speeds, stretching of the filaments can be obtained. While stretching can be accomplished in one step, it may be desirable to stretch the filaments in two steps. Typically, the filaments will be stretched 3 to 4 times the extruded length (i.e., stretched at a ratio of from 3:1 to 4:1). Subsequent to stretching, and in order to obtain a carpet yarn, it is desirable to texture the yarn with pressured air at an elevated temperature (e.g., 135° C.) or steam jet and to subject it to crimping or texturizing.

Spin finishes can be applied to fibers at different stages of the production process, depending upon what balance of performance properties are demanded from the fiber at that particular production stage. A primary spin finish is generally applied to the fibers soon after they are extruded from the spinneret, cooled, and bundled, but prior to stretching, texturizing or crimping the fiber. The primary spin finish reduces fiber-to-metal or fiber-to-ceramic friction while the fiber travels along the early stage production equipment.

Application of a secondary spin finish is often necessary during the later stage production (i.e., after stretching, crimping and texturizing of the fiber). Weaving often requires higher bundle cohesion than can be tolerated during spinning of staple fibers. The secondary spin finish imparts greater adhesion and friction to the yarn or rope made from the yarn.

While ideally the primary spin finish would have properties which eliminate the need for any secondary spin finish, this is not always possible. For example, during production, fiber-to-metal or fiber-to-ceramic friction should be low, but the final article (rope, for example) may benefit from higher friction. A primary spin finish must be optimized to allow the initial stages of yarn production to proceed in an efficient manner. If the succeeding stages have different requirements, a secondary finish will have to be applied. A secondary finish will also have to be applied if the primary spin finish is removed, or almost removed, during a processing step. For example, the majority of primary spin finish is removed during dyeing of yarn or cloth in aqueous dyeing baths. Examples of these considerations abound in the cited literature.

The low melting, high solids, optionally water- and oil-repellent spin finish composition of this invention is a waxy solid having a melting point ranging from about 25° to about 140° C., and more preferably from about 30° to about 80° C. To use a spin finish composition of this invention, the waxy solid is first melted to form an oil. Using heat traced conventional spin finish equipment, the resulting oil can be easily and uniformly applied as a spin finish to freshly made synthetic fiber at levels from about 0.2% SOF to about 4% SOF, preferably at levels from about 0.5% SOF to about 2% SOF, and more preferably at levels from about 0.75% SOF to about 1.4% SOF. The actual amount necessary for treating the fiber depends on both the spin finish composition and the oleophilicity of the fiber. For example, when a relatively oleophilic spin finish composition having a low HLB value is applied to a relatively oleophilic fiber such as polypropylene, a higher % SOF is required to provide surface lubricity to the fiber due to the absorption of the spin finish composition into the fiber.

Immediately after being applied to the fiber, the spin finish oil cools and solidifies to a lubricious solid. This lubricious solid provides sufficient lubrication to the surface of the fiber to allow the fiber to move easily past pulleys, godets, guides, winders, and other components of the fiber-making equipment. At the same time, application problems typically encountered with solid spin finish compositions, such as "sling off" from the fiber or the deposition of spin finish solids on the machine rolls, surfaces and glides, are avoided.

In order for the low melting, high solids spin finish composition to perform effectively as a soil-resistant finish, the surfactant(s) used in the composition should have a weighted average HLB value in the range of about 2 to 13, preferably in the range of about 3 to 12. "HLB value" is a term used to measure the degree of hydrophilicity of a nonionic hydrocarbon surfactant. HLB values can be calculated experimentally from the partitioning ratio of a hydrocarbon surfactant between an aliphatic hydrocarbon solvent and water. Alternatively, for hydrocarbon surfactants, HLB values can be calculated theoretically directly from their structures by summing empirically derived group numbers for each portion of the structure. For a spin finish composition containing two or more hydrocarbon surfactants, the weighted average HLB value can be calculated. For example, a formulator could achieve an HLB value of 7.5 by mixing together equal portions by weight of hydrocarbon surfactants having HLB values of 5 and 10, respectively. In general, surfactants with lower HLB values have longer hydrocarbon chains and/or a lower degree of ethoxylation, resulting in a relatively hydrophobic surfactant having low water solubility. Conversely, surfactants with higher HLB values have shorter hydrocarbon chains and/or a higher degree of ethoxylation, resulting in a relatively hydrophilic surfactant having high water solubility. (For detailed information concerning HLB values, their determinations and their measurements, see Schick, Martin J., *Nonionic Surfactants, Physical Chemistry,* 23, 438–456 (1987)).

The low melting, high solids spin finish compositions of the present invention are also advantageous to manufacture and use, as the expensive and troublesome emulsification step required with conventional low solids, water-based spin finishes is eliminated. Material transportation costs are also reduced due to lower volumes of neat low melting spin finish required at the production facility, and air and water pollution problems are minimized due to the absence of solvents and emulsifiers.

Preferred hydrocarbon surfactants useful in the high solids low melting spin finish compositions of this invention include polyethylene glycol 400 distearate, polyethylene glycol 300 distearate, polyethylene glycol 200 distearate, polyoxyethylene 600 distearamide and glycerol monostearate.

For a fluorochemical to be compatible with a hydrocarbon surfactant of this invention (i.e., compatible at line operating temperatures which typical are in the range of about 40–140° C., preferably about 80–120° C.), the fluorochemical should have an FLB value of less than 11. For example, consider the calculation of the FLB value for EtFOSE Stearate, $C_8F_{17}SO_2N(C_2H_5)C_2H_4OC(O)C_{17}H_{35}$:

Molecular weight (MW) of fluorochemical segment =MW of $C_8F_{17}$=419

Total MW=of $C_8F_{17}SO_2N(C_2H_5)C_2H_4OC(O)C_{17}H_{35}$=837

FLB value =(419)/(837)×20=10.0

According to this calculation, EtFOSE Stearate is expected to be a compatible fluorochemical.

Now consider the calculation of the FLB value for 2MeFOSE/AZA, $C_8F_{17}SO_2N(CH_3)CH_2CH_2OC(O)(CH_2)_7C(O)OCH_2CH_2N(CH_3)SO_2C_8F_{17}$:

Molecular weight (MW) of fluorochemical segment =MW of $2\times C_8F_{17}$=838

Total MW=MW of 2MeFOSE/AZA=1266

FLB value =(838) / (1266)×20=13.3

According to this calculation, 2MeFOSE/AZA is not expected to be a compatible fluorochemical The present invention also relates to a process for making water- and oil-repellent fibers and articles woven from such fibers comprising the steps of: (1) incorporating a repellent fluorochemical into a thermoplastic polymer melt, (2) extruding a fiber from the polymer melt, and (3) applying to the fiber a low melting, high solids spin finish composition consisting essentially of nonionic surfactant components having a weighted average HLB value of from about 2 to 13. Examples of suitable repellent fluorochemical polymer melt additives are well known in the art and include oxazolidinones of the type described in U.S. Pat. No. 5,025,052 (Crater et al.); esters of the type described in U.S. Pat. No. 5,459,188 (Sargent et al.), World Publications WO 97/22576 and WO 97/22659, U.S. Ser. No. 08/901,363 filed Jul. 28, 1997; imides of the type described in U.S. Pat. No. 5,681,963 (Liss); sulfones of the type described in World Publication WO 97/22660, polymerized olefins of the type described in U.S. Pat. No. 5,314,959 (Rolando et al.), piperazines of the type described in U.S. Pat. No. 5,451,622 (Boardman et al ), and amino alcohols of the type described in U.S. Pat. No. 5,380,778 (Buckanin). These repellent fluorochemical polymer melt additives can be incorporated into the fiber resin at concentrations varying from 0.1–5.0% (w/w), preferably from 0.15–1.0% (w/w), prior to spinning the fiber and applying the spin finish. Surprisingly, the fluorochemical present in the fiber can exert repellency properties through the layer of non-fluorochemical solid spin finish present on the surface of the fiber.

EXAMPLES

DERIVATIZED POLYETHERS—PREPARATION, SOURCES

PEG400DS (polyethylene glycol 400 distearate, having an HLB value of 8.4) - 100 g (0.25 mol) of polyethylene glycol 400 M.W. (available from Aldrich Chemical Co., Milwaukee, Wis.) was combined with 142 g (0.5 mol) of stearic acid in 400 g of toluene in a 3-necked flask equipped with stirrer, heating mantle, thermometer and condenser The contents were heated, azeotroped dry using a Dean Stark trap and were allowed to cool. Next, 1.0 g(0.5% by weight of solids) of p-toluene sulfonic acid was added, and the mixture was refluxed with stirring overnight with the continuous removal of water. Infrared analysis indicated no acid carbonyl remained. A solution of 0.5 g of $NaHCO_3$ in deionized water was then added. The resulting two-phase system was stirred and the water and toluene were removed at 80° C. using a ROTO-VAC™ evaporator to produce the desired monoester, $C_{17}H_{35}C(O)O(C_2H_4O)_8C_2H_4OC(O)C_{17}H_{35}$.

EMEREST™ 2712 surfactant (available from Henkel Corp., Chemicals Group, Ambler, Pa.)—PEG400DS PEG400DS emulsion—A PEG400DS emulsion was prepared as follows. 200 g of PEG400DS was heated in an oven to 70° C. to a molten state. In a separate bottle, 10 g of RHODACAL™ DS-10 surfactant (available from Rhone Poulenc, Cranbury, N.J.) was dissolved in 1190 g of deionized water, and the resulting aqueous solution was heated to 70° C. The molten PEG400DS was placed in a stainless steel beaker, stirred vigorously, and the aqueous solution was added. With continued stirring, a sufficient amount of 20% (w/w) aqueous NaOH was added to bring the pH up to around 6.0. The resulting mixture was then hydrogenized for 20 minutes using a BRANSON™ Sonifier Ultrasonic Horn (available from VWR Scientific). The translucent emulsion produced was transferred to a polyethylene bottle, which was capped and rolled on a jar mill until cooled to around room temperature. The resulting PEG400DS emulsion was 15.2% (w/w) solids.

PEG1000DS (polyethylene glycol 1000 distearate, having an HLB value of 12.9)—PEG1000DS was made using essentially the same procedure as described for preparing PEG400DS , except that the polyethylene glycol 400 M.W. was replaced by an equimolar amount of polyethylene glycol 1000 M.W. (available from Aldrich Chemical Co.).

PEG600DS (polyethylene glycol 600 distearate, having an HLB value of 10.4)—PEG600DS was made using essentially the same procedure as described for preparing PEG400DS , except that the polyethylene glycol 400 M.W. was replaced by an equimolar amount of polyethylene glycol 600 M.W.

PEG300DS (polyethylene glycol 300 distearate, having an HLB value of 6.5)—PEG300DS was made using essentially the same procedure as described for preparing PEG400DS , except that the polyethylene glycol 400 M.W. was replaced by an equimolar amount of polyethylene glycol M.W. 300.

PEG200DS (polyethylene glycol 200 distearate, having an HLB value of 5.5)—PEG200DS was made using essentially the same procedure as described for preparing PEG400DS , except that the polyethylene glycol 400 M.W. was replaced by an equimolar amount of polyethylene glycol M.W. 200.

DEGDS (diethylene glycol distearate, having an HLB value of 2.8)—DEGDS was made using essentially the same procedure as described for preparing PEG400DS , except that the polyethylene glycol M.W. 400 was replaced by an equimolar amount of diethylene glycol.

PEG2000DB (polyethylene glycol 2000 dibehenate, having an HLB value of 15.1)—PEG2000DB was made using essentially the same procedure as described for preparing PEG400DS , except that the polyethylene glycol M.W. 400 was replaced by an equimolar amount of polyethylene glycol M.W. 2000 and the stearic acid was replaced by an equimolar amount of behenic acid.

PTHF650DS (polytetrahydrofuran glycol 650 distearate, HLB value not known)—PTHF650DS was made using essentially the same procedure as described for preparing PEG400DS , except that the polyethylene glycol M.W. 400 was replaced by an equimolar amount of polyTHF glycol (available from BASF Corporation, Mt. Olive, N.J.).

MPEG750MS (methoxypolyethylene glycol 750 monostearate, having an HLB value of 14.8)—MPEG750MS was made using essentially the same procedure as described for preparing PEG400DS , except that the polyethylene glycol M.W. 400 was replaced by an equimolar amount of CARBOWAX™ 750 alcohol (MPEG750, available from Union Carbide Corp., S. Charleston, W.Va.) and 71 g (0.25 mol) of stearic acid was used.

ED-600DSA (JEFFAMINE™ ED-600 distearamide, having an HLB value of 9.0)—To a 3-necked round-bottom flask equipped with stirrer, heating mantle and thermometer were added 100 g (0.084 mol) of JEFFAMINE™ ED-600 polyoxyethylene diamine (commercially available from Huntsman Chemical Co., Houston, Tex.), 47.4 g (0.17 mol) of stearic acid and 0.15 g (0.1 wt %) of IRGANOX™ 1010 antioxidant (commercially available from Ciba-Geigy° Corp., Greensboro, N.C.). The mixture was heated at 150° C. under nitrogen for 2–3 hours, followed by heating at 180–200° C. for an additional 7–8 hours. Infrared spectroscopy of this material showed an -NH peak at 3305 $cm^{-1}$ with the disappearance of —COOH peaks and the disappearance of primary amine peaks, confirming the formation of the distearamide, $C_{17}H_{35}C(O)NHCH(CH_3)CH_2O(CH_2CH_2O)_{12}CH_2CH(CH_3)NHC(O)C_{17}H_{35}$.

MPEG750MSU (methoxypolyethylene glycol 750 monostearyl urethane, having an HLB value of 14.3)—To a 2-necked, l-L round bottom flask equipped with magnetic stirring bar, condenser and thermometer was added 200 g (0.286 mol) of MPEG750 and 84.4 g (0.286 mol) of octadecyl isocyanate (both commercially available from Aldrich/Sigma Chemical Co, Milwaukee, Wis.), 350 g of toluene and 2–3 drops of dibutyltin dilaurate The mixture was heated to 55–60° C. and was stirred gently for 8 hours. At this time, IR analysis showed total reaction of the isocyanate groups. The toluene was then stripped off and the urethane, $CH_3O(C_2H_4O)_{17}C(O)N(H)C_{18}H_{37}$, was isolated.

STDEA (stearoyl diethanolamide, $C_{17}H_{35}C(O)N(C_2H_4OH)_2$, having an HLB value of 5.4)—available from Lipo Chemicals, Inc., Fairlawn, N.J.

methyl stearate (having an HLB value of 1.5)—available from Aldrich Chemical Co.

stearyl stearate (having an HLB value of <1.0)—available from Rhodia, Inc., Cranbury, N.J.

stearyl alcohol (having an HLB value of <1.0)—available from available from Aldrich Chemical Co.

glyceryl monostearate (having( an HLB value of 3.4)—available from Henkel Corp., Cincinnati, Ohio.

COMPATIBLE FLUOROCHEMICALS PREPARATION, SOURCES

FC/HC Urethane A (having a calculated FLB value of 5.6)—To a 2000 mL round-bottom flask was added 184 (0.33 eq) of MeFOSE Alcohol ($C_8F_{17}SO_2N(CH_3)CH_2CH_2OH$, available from 3M Co., St. Paul, Minn.), 223 g (0.86 eq) of DESMODURIM™ N-75 (available from Bayer Corp., Coatings Div., Pittsburgh, Pa.), 439 g of methyl ethyl ketone (MEK) and 0.49 g of dibutyltin dilaurate (DBTDL,). The reaction mixture was refluxed for 90 minutes, and 144 g (0.53 eq) of stearyl alcohol was added. The reaction mixture was refluxed for an additional 90 minutes. The reaction mixture was then poured into aluminum pans and dried in a 125° C. oven for 2.5 hours to recover the 38/62 (mol) fluorochemical/hydrocarbon urethane.

FC/HC Urethane B (having a calculated FLB value of 6.5)—To a 2000 mL round-bottom flask was added 215 g (0.38 eq) of MeFOSE Alcohol, 215 g (0.83 eq) of DESMODUR™ N-75, 441 g of MEK and 0.49 g of DBTDL. The reaction mixture was refluxed for 90 minutes, and 121 g (0.45 eq) of stearyl alcohol was added. The reaction mixture was refluxed for an additional 90 minutes. The reaction mixture was then poured into aluminum pans and dried in a 125° C. oven for 2.5 hours to recover the 46/54 (mol) fluorochemical/hydrocarbon urethane.

FC/HC Urethane C (having a calculated FLB value of 8.4)—To a 2000 mL round-bottom flask was added 246 g (0 44 eq) of MeFOSE Alcohol, 205 g (0.79 eq) of DESMODUR™ N-75, 444 g of MEK and 0.49 g of DBTDL,. The reaction mixture was refluxed for 90 minutes, and 95 g (0.35 eq) of stearyl alcohol was added. The reaction mixture was refluxed for an additional 90 minutes. The reaction mixture was then poured into aluminum pans and dried in a 125° C. oven for 2.5 hours to recover the 56/44 (mole) fluorochemical/hydrocarbon urethane.

EtFOSE Stearate ($C_8F_{17}SO_2N(C_2H_5)C_2H_4OC(O)C_{17}H_{35}$, having a calculated FLB value of 10.0)—To a round-bottom flask was added 625 g (1.094 mol) of distilled EtFOSE alcohol ($C_8F_{17}SO_2N(C_2H_5)CH_2CH_2OH$, available from 3M Co.), 311.3 g (1.094 mol) of stearic acid (95% pure, available from Aldrich Chem. Co.), 0.5 g of $CH_3SO_3H$ and 1L of toluene. The resulting mixture was refluxed until a theoretical amount of water from the esterification reaction was collected. The reaction mixture was filtered hot to remove particulates. Infrared analysis confirmed formation of the ester group.

2MeFOSE/Dimer Ester ($C_8F_{17}SO_2N(CH_3)CH_2CH_2OC(O)C_{34}H_{62}C(O)O—CH_2CH_2N(CH_3)SO_2C_8F_{17}$, having a calculated FLB value of 10.0)—This fluorochemical alcohol dimer acid ester was prepared by esterifying MeFOSE alcohol ($C_8F_{17}SO_2N(CH_3)CH_2CH_2OH$, having an equivalent weight of 540, made in two stages by reacting POSF with methylamine and ethylenechlorohydrin, using a procedure similar to that described in Example 1 of U.S. Pat. No. 2,803,656) with Empol™ 1008 dimer acid (a distilled and hydrogenated dimer acid based on oleic acid, having an acid equivalent weight of 305 as determined by titration, commercially available from Henkel Corp./Emery Group, Cincinnati, Ohio) at a molar ratio of 2:1 using the following procedure.

A 500 mL 2-necked round-bottom flask equipped with overhead condenser, thermometer and Dean-Stark trap wrapped with heat tape was charged with 57.8 g (0.190 eq) of Empol™ 1008 dimer acid, 100 g (0.185 eq) of MeFOSE, 1 g of p-toluenesulfonic acid and 50 g of toluene. The resulting mixture was placed in an oil bath heated to 150° C. The degree of esterification was monitored by measuring the amount of water collected in the Dean-Stark trap and also by using gas chromatography to determine the amount of unreacted fluorochemical alcohol. After 18 hours of reaction, about 2.8 mL of water was collected and a negligible amount of fluorochemical alcohol remained, indicating a complete reaction. The reaction mixture was then cooled to 100° C. and was twice washed with 120 g aliquots of deionized water to a water pH of 3. The final wash was removed from the flask by suction, and the reaction mixture was heated to 120° C. at an absolute pressure of about 90 torr to remove volatiles. The product, a brownish solid, was characterized as containing the desired product by $^1H$ and $^{13}C$ NMR spectroscopy and thermogravimetric analysis.

REPELLENT FLUOROCHEMICALS PREPARATION, SOURCES

2MeFOSE/ODSA ($C_8F_{17}SO_2N(CH_3)CH_2CH_2OC(O)CH_2CH(C_{18}H_{35})C(O)OCH_2CH_2N(CH_3)SO_2C_8F_{17}$, having a calculated FLB value of 11.6)—To a mixture of 64.7 g (0.0924 mol) octadecenyl succinic anhydride (available from Milliken Chem. Co., Spartanburg, S.C.) and 100 g (0. 1994 mol) of MeFOSE alcohol ($C_8F_{17}SO_2N(CH_3)CH_2CH_2OH$) was added 1 g of $CH_3SO_3H$. The resulting mixture was heated to 150° C. for 3–4 hours under a nitrogen atmosphere. To this mixture was then added 100 mL of toluene and a second equivalent (0.1794 mol, 100 g) of MeFOSE alcohol, and this mixture was refluxed at 135° C. for 12 hours using a Dean-Stark apparatus. 5 g of $Ca(OH)_2$ was mixed in and this mixture was filtered hot to remove the precipitate. The toluene was removed from the filtrate under reduced pressure using a ROTOVAP™ evaporator and the desired solid was recovered.

2MeFOSE/DDSA (di-MeFOSE alcohol ester of dodecenyl succinic anhydride, having a calculated FLB value of 12.3)—To a round-bottom flask was added 29.9 g (0.1121 mol) of dodecenyl succinic anhydride (available from Aldrich chemical Co.), 125 g (0.2243 mol) of MeFOSE alcohol $C_8F_{17}SO_2N(CH_3)CH_2CH_2OH$), 0.5 mL of $CH_3SO_3H$ and 200 mL of toluene. The resulting mixture was heated to reflux using a Dean-Stark apparatus. After 10 hours, 1.2 mL of water had been collected, indicating that the reaction was not yet complete. Toluene was removed using a ROTOVAP™ evaporator and sufficient xylene was added to increase the reflux temperature to 140° C. 0.5 mL of additional water was collected. After an additional 7 hours, $Ca(OH)_2$ was added, the precipitate was removed through hot filtration, and the xylene was removed from the filtrate using the ROTOVAP™ evaporator to recover the desired product.

2MeFOSE/OSA (di-MeFOSE alcohol ester of octenyl succinic anhydride, having a calculated FLB value of 12.8)—To a round-bottom flask was added 25 g (0.119 mol) of octenyl succinic anhydride (available from Aldrich Chemical Co.), 132.7 g (0.238 mol) of MeFOSE alcohol ($C_8F_{17}SO_2N(CH_3)CH_2CH_2OH$), 1 mL of $CH_3SO_3H$ and 150 mL of toluene. The resulting mixture was heated to reflux using a Dean-Stark apparatus. After 15 hours, water had collected. Infrared analysis showed no remaining —OH peaks, indicating that the reaction was complete. Toluene was removed using a ROTOVAP™ evaporator. The melting point of the residue was 67.9° C. as measured by differential scanning calorimetry.

2MeFOSE/AZA($C_8F_{17}SO_2N(CH_3)CH_2CH_2OC(O)(CH_2)_7C(O)OCH_2CH_2N(CH_3)SO_2C_8F_{17}$, having a calculated FLB value of 13.3)—To a round bottom flask was added 25 g (0.1314 mol) of azelaic acid (available from Henkel Corp.), 146.2 g (0.2628 mol) of MeFOSE alcohol, 200 g of toluene and 0.5% by weight of solids of $CH_3COOH$. This mixture was refluxed until the theoretical amount of water was collected in the Dean-Stark apparatus. To the dehydrated mixture was mixed in 5 g $Ca(OH)_2$, and the resulting mixture was filtered hot. The toluene was removed from the filtrate under reduced pressure using a ROTOVAP™ vacuum evaporator and the desired solid was recovered. This solid showed no—OH peak by infrared analysis, indicating complete conversion to the diester.

2FC-Telomer/AZA (di-fluorochemical telomer alcohol ester of azelaic acid, having a calculated FLB value of 14.5)—To a round-bottom flask was added 20.1 g (0.1051 mol) of azelaic acid, 99.9 g(0.1051 mol) of ZONYL™ BA alcohol ($C_8F_{17}CH_2CH_2OH$, available from DuPont Corp., Wilmington, Del.), a pinch of p-$CH_3C_6H_4SO_3H$ and 150 mL of toluene. The resulting mixture was refluxed until the theoretical amount of water was collected in the Dean-Stark apparatus (about 12–15 hours). The toluene was removed from the filtrate under reduced pressure using a ROTOVAP™ vacuum evaporator and the desired solid was recovered.

FC Adipate Ester (having a calculated FLB value of 11.0)—The preparation of this fluorochemical adipate ester is described in U.S. Pat. No. 4,264,484, Example 8, formula XVII.

TEST METHODS

Fiber Drawing and Texturizivg Procedure-Polypropylene resin having a melt-flow index of approximately 17 was melt-spun in the conventional manner through a spinneret at a rate of 91 g/min to provide 80 filaments with a delta-shaped cross-section. The molten filaments were then passed across an air quench tower maintained at 15° C. (60° F.) whereupon solidification of the filaments occurred. The solid filaments were collected into fibers which were directed across a slotted ceramic guide.

Unless otherwise specified, molten spin finish was then applied at a level of approximately 0.75% solids on fiber (SOF). The lines and pump were maintained at around 65° C. (149° F.) or higher by wrapping them with heat tape controlled by a Variac™ variable autotransformer. From the spin finish ceramic Guide, the treated fiber traveled over a turnabout to the first godet. The fiber was wrapped 6 times around the first godet, said godet being heated to 85° C. From the first godet, the bundle traveled to the second godet, where it was wrapped 6 times. The second godet was maintained at 115° C. and its speed was adjusted to three times that of the first godet, thus drawing the fiber at a ratio of 3:1. From the second godet, the fiber traveled to a conventional hot air texturizer set at 135° C. and 7 bar (700,000 Pa) pressure to form a yarn. The resulting yarn then traveled to a third godet set at room temperature (i.e., about 25° C.), where it was wrapped 6 times, and finally to a conventional winder, Denier of the drawn and texturized yarn was maintained at approximately 1450 denier by adjustment of polymer output at the spinneret.

Both polypropylene and nylon fiber were prepared using this procedure. The source of polypropylene used to make fiber was polypropylene resin having a melt-flow index of approximately 17. The source of nylon used to make fiber was ULTRAMID™ nylon, available from BASF Corp.

Determination of Roll Build-Up Procedure—This test was developed to simulate possible build-up of spin finish residue on the godets, winder and other machinery parts of a fiber spinning, fine. It is desired to keep these residues to a minimum to insure optimum fiber line performance and reduce the need for periodic machine clean-up.

The same procedure was followed as described in the Fiber Drawing and Texturizing Procedure, except that the fiber was directed around three (rather than two) godets, maintaining each godet at room temperature. Each godet was run at approximately the same speed to prevent drawing, of the polypropylene fiber. The undrawn fiber was then collected on a winder, eliminating the texturizing step. Fiber output was adjusted to dive a denier of approximately 4500.

After being allowed to run for one hour, the fiber line was stopped, all residue was removed from the three godets, the residue was pooled and was weighed in grams. The number of grams of residue was reported as "Residue on Godets."

Coefficient of Friction Measurement—When measurement of coefficient of friction was desired, the yarn from the texturizer was wound 6 times around a fourth godet, across the tension transducer, across the friction pin, across the second tension transducer, 6 times around another godet and onto the winder.

At a given line speed, the apparent coefficient of friction (COF) between the fiber and the metal friction pin can be calculated using the following "capstan" equation:

$$COF=in\ (T_1/T_0)/q.$$

where $T_1$ is the tension on the fiber just before the metal friction pin, $T_0$ is the tension on the fiber just after the metal friction pin, and q is the angle of contact in radians between the fiber and the metal friction pin. For all examples, $T_0$ was standardized at 200 g and q was standardized at 3.002 radians (corresponding to the 25.4 mm diameter pin used). For all examples, the line speed was maintained at about 270 m/min.

The tension measurements were made using two Rothschild Permatens™ measuring heads obtained from Lawson-Hemphill, Inc., Central Falls, R.I. Using a realtime data aquisition computer, the tension readings were recorded for each run at one second intervals over a 40-second time period.

A COF value of 0.30 or less is considered desirable, although COF values above 0.30 may be acceptable.

Determining Percent Lubricant on Fiber—The % SOF of spin finish composition actually coated onto the fiber was determined in accordance with the following test procedure.

An 8 g sample of spin finish-coated fiber is placed in an 8 oz (225 mL) glass jar along with 80 g of solvent (typically ethyl acetate or methanol). The glass jar is capped and placed on a roller mill for 10 minutes. Next, 50 g of the solvent containing the stripped lubricant is removed and is poured into a tared aluminum pan which is placed in a 250° F. ( 121° C.) vented oven for 20 minutes to evaporate the solvent. The pan is then reweighed to determine the amount of lubricant present, using the following calculation:

$$\%SOF=(\text{grams of finish extracted})/(5\ \text{grams})\times 100$$

Carpet Tufting Procedure—Samples of texturized fiber (i.e., yarn) were tufted into a level-loop style carpet at 5/32 guage, 12 stitches per inch (5 stitches per centimeter) and 0.25 inch (0.64 cm) pile height.

"Walk-On" Soiling Test—The relative soiling potential of carpet tufted from texturized fiber was determined by challenging both treated and untreated (control) carpet samples under defined "walk-on" soiling test conditions and comparing their relative soiling levels. The test is conducted by mounting treated and untreated carpet squares on particle board, placing the samples on the floor of one of two chosen commercial locations, and allowing the samples to be soiled by normal foot traffic. The amount of foot traffic in each of these areas is monitored, and the position of each sample within a given location is changed daily using a pattern designed to minimize the effects of position and orientation upon soiling.

Following a specific soil challenge period, measured in number of cycles where one cycles equals approximately 10,000 foot-traffics, the treated samples are removed and the amount of soil present on a given sample is determined using colorimetric measurements. This colorimetric measurement method makes the assumption that the amount of soil on a given sample is directly proportional to the difference in color between the unsoiled sample and the corresponding sample after soiling. The three CIE L*a*b* color coordinates of the unsoiled and subsequently soiled samples are measured using a Minolta 310 Chroma Meter with a D65 illumination source. The color difference value, ΔE, is calculated using the equation shown below:

$$\Delta E=[(\Delta L^*)^2+(\Delta a^*)^2+(\Delta b^*)^2]^{1/2}$$

where: $\Delta L^*=L^*\text{soiled}-L^*\text{unsoiled}$ $\Delta a^*=a^*\text{soiled}-a^*\text{unsoiled}$ $\Delta b^*=b^*\text{soiled}-b^*\text{unsoiled}$ ΔE values calculated from these colorimetric measurements (Usually an average of six replicates) are qualitatively in agreement with values from older, visual evaluations, such as the soiling evaluation suggested by the AATCC. Using ΔE values rather than absolute soiling measurements provides higher precision, as ΔE values are essentially unaffected by evaluation environment or subjective operator differences. Generally, the number of cycles is chosen so that the ΔE value for the soiled scoured carpet is around 3–4, representing a level of soiling visible to the naked eye. A ΔE value for unscoured carpet of no greater than 6 is considered desirable.

A "ΔΔE" value can be readily calculated by subtracting the ΔE value of soiled scoured carpet from the ΔE value of soiled, spin finish-treated carpet. The ΔΔE value is especially useful as it represents a direct comparison of soiling between spin finish-treated carpet and scoured carpet. A ΔΔE value of at least no greater than 3 is considered desirable.

Water Repellency Test—Carpet tufted from texturized fiber was evaluated for water repellency using 3M Water Repellency Test V for Floorcoverings (February 1994), available from 3M Company. In this test, a carpet sample is challenged to penetrations by blends of deionized water and isopropyl alcohol (IPA) Each blend is assigned a rating number as shown below:

| Water Repellency Rating Number | Water/PA Blend (% by volume) |
|---|---|
| F | (fails water) |
| 0 | 100% water |
| 1 | 90/10 water/IPA |
| 2 | 80/20 water/IPA |
| 3 | 70/30 water/IPA |
| 4 | 60/40 water/IPA |
| 5 | 50/50 water/IPA |
| 6 | 40/60 water/IPA |
| 7 | 30/70 water/IPA |
| 8 | 20/80 water/IPA |
| 9 | 10/90 water/IPA |
| 10 | 100% IPA |

In running the Water Repellency Test, a treated carpet sample is placed on a flat, horizontal surface and the carpet pile is hand-brushed in the direction giving the greatest lay to the yarn. Five small drops of water or a water/IPA mixture are gently placed at points at least two inches apart on the carpet sample. If, after observing for ten seconds at a 45° angle, four of the five drops are visible as a sphere or a hemisphere, the carpet is deemed to pass the test. The reported water repellency rating corresponds to the highest numbered water or water/IPA mixture for which the treated carpet sample passes the described test.

A water repellency value of at least 0, preferably at least 2, is considered desirable.

Oil Repellency Test—Carpet tufted from texturized fibers was evaluated for oil repellency using 3M Oil Repellency Test III (February 1994), available from 3M Company, St. Paul, Minn. In this test, a treated carpet sample is challenged to penetration by oil or oil mixtures of varying surface tensions. Oils and oil mixtures are given a rating corresponding to the following:

| Oil Repellency Rating Number | Oil Composition |
|---|---|
| F | (fails mineral oil) |
| 1 | mineral oil |
| 1.5 | 85/15 (vol) mineral oil/n-hexadecane |
| 2 | 65/35 (vol) mineral oil/n-hexadecane |
| 3 | n-hexadecane |
| 4 | n-tetradecane |
| 5 | n-dodecane |
| 6 | n-decane |

The Oil Repellency Test is run in the same manner as is the Water Repellency Test, with the reported oil repellency rating corresponding to the highest oil or oil mixture for which the treated carpet sample passes the test.

An oil repellency value of at least 2 is considered desirable.

EXAMPLES

The following examples are presented to further illustrate the invention without intending to limit the invention thereto. All percentages given in the examples are based on weight/weight solids, unless otherwise specified.

COMPARATIVE EXAMPLE C1

Using the Determination of Roll Build-Up Procedure, polypropylene filaments were treated with PEG400DS emulsion (15.2% solids by weight) applied at 0.75% SOF at ambient temperature using a gear pump. After the line was stopped, 2.51 g of total residue was removed from the three godets. Additionally, there was a visible buildup of spin finish solids on the traverse guide and other parts of the winder.

EXAMPLE 1

Using the Determination of Roll Build-Up Procedure, polypropylene filaments were treated with neat molten PEG400DS (the PEG400DS melted at around 37° C.). Theoretical application level was 0.7% SOF, though determination of lubricant level on the fiber using solvent extraction showed an actual level of 1.05% SOF. After the line was stopped, no measurable buildup or deposit of PEG400DS solids was noted either on the godets or on the winder.

EXAMPLE 2

The same Determination of Roll Build-Up Procedure was followed and the same neat spin finish was applied as described in EXAMPLE 1, except that the time for making the treated polypropylene fiber was increased from 1 to 1.5 hours. Again, no measurable buildup or deposit of PEG400DS solids was found either on the godets or on the winder

EXAMPLES 3–12

Using the Determination of Roll Build-Up Procedure, polypropylene filaments were treated with PEG400DS and several other low melting neat spin finishes. In EXAMPLE 13, EtFOSE Stearate, a fluorochemical spin finish, was run. After the line was stopped, the total number of grams of spin finish residue accumulated by the three godets was measured. Results are shown in TABLE 1.

COMPARATIVE EXAMPLES C2–C4

The same Determination of Roll Build-Up Procedure was followed as described in COMPARATIVE EXAMPLE C1 except that, in addition to PEG400DS , two other water dispersed spin finishes were evaluated. After the line was stopped, the total number of grains of spin finish residue accumulated by the three godets was measured. Results are shown in TABLE 1

EXAMPLE 14 and COMPARATIVE EXAMPLE C5

PEG400DS was applied in both a neat molten state (EXAMPLE 14) and as a 15.4% (wt) solids water emulsion (EXAMPLE C5) to nylon fiber, using the Determination of Roll Build-Up Procedure described in EXAMPLE 1 and COMPARATIVE EXAMPLE C 1, respectively. After the line was stopped, the total number of grams of spin finish residue accumulated by the three godets was measured Additionally, some of the treated fibers (i.e., fibers from EXAMPLES 3, 4, 7 and 8) were texturized and tufted into a carpet using the Carpet Tufting Procedure. These carpets were evaluated for soil resistance using the "Walk-On" Soiling Test. A scoured carpet control (COMPARATIVE EXAMPLE C5A) was prepared by scouring the PEG400DS spin finish from the carpet made from EXAMPLE 3 fiber. Scouring was done by continuously rotating the carpet through a Beck style hot water bath followed by spin extraction and drying.

Results are shown in TABLE 1.

TABLE 1

| Ex. | Spin Finish | HLB Value | Delivery System | Residue on Godets (g) | ΔΔE Value |
|---|---|---|---|---|---|
| 3 | PEG400DS | 8.4 | Neat | 0.12 | 0.8 |
| C2 | PEG400DS | 8.4 | water dispersion | 1.14 | — |
| 4 | PBG200DS | 5.3 | Neat | 0.04 | 0.2 |
| C3 | PEG200DS | 5.3 | water dispersion | 1.40 | — |
| 5 | PTHF650DS | N/A** | Neat | 0.12 | — |
| C4 | PTHF650DS | N/A** | water dispersion | 2.15 | — |
| 6 | ED-600DSA | 9.0 | Neat | 0.31 | — |
| 7 | PEG2000DB | 15.1 | Neat | 0.00 | 3.9 |
| 8 | MPEG750MS | 14.8 | Neat | 0.11 | 4.0 |
| 9 | MPEG750MSU | 14.3 | Neat | 0.00 | — |
| 10 | methyl stearate | 1.5 | Neat | 0.19 | — |
| 11 | stearyl stearate | <1.5 | Neat | 0.00 | — |
| 12 | stearyl alcohol | <1.5 | Neat | 0.20 | — |
| 13 | EtFOSE Stearate | — | Neat | 0.02 | — |
| 14* | PEG400DS | 8.4 | Neat | 0.12 | — |
| C5* | PEG400DS | 8.4 | water dispersion | 1.30 | — |
| C5A | scoured carpet | — | — | — | 0 |

*EXAMPLE 14 and COMPARATIVE EXAMPLE C5 were run using nylon fiber
**HLB value not available but expected to be between 2 and 13

The data in TABLE 1 show that, with a variety of hydrocarbon surfactant spin finish compositions, the neat spin finish compositions consistently gave lower accumulations on the three godets as compared to their water dispersion counterparts. Also, the level of accumulation was not dependent on the HLB number of the hydrocarbon surfactant.

The data in TABLE 1 also show that, compared to the scoured carpet control, soil resistance was excellent for the carpets woven from treated fibers of EXAMPLES 3 and 4, which were treated with hydrocarbon surfactant spin finishes having HLB values of 8.4 and 5.3, respectively (i.e., HLB values between 2 and 13). However, soil resistance was marginal for the carpets woven from treated fibers of EXAMPLES 7 and 8, which were treated with hydrocarbon surfactant spin finishes having HLB values of 15.1 and 14.8, respectively (i.e., HLB values greater than 13). Hydrocarbon surfactants having an HLB value of lower than 2 (methyl stearate at 1.5, stearyl stearate at <1.5 and stearic acid at <1.5) caused the spin finish to be absorbed significantly in the polypropylene fiber, causing some softening of the fiber and potentially poorer soil resistance of the resulting woven carpets.

EXAMPLES 15–24

In this series of experiments, fluorochemicals were evaluated as potential compatible fluorochemicals in neat spin finishes with PEG400DS hydrocarbon surfactant.

Each fluorochemical was mixed neat at 10% by weight with EMEREST™ 2712 surfactant, the mixture was made molten by heating to 120–130° C. for ½ hour with occasional agitation, and the mixture was allowed to cool to room temperature. One additional heat/cool cycle was then run. The compatibility of the mixture was measured by observing the amount of precipitation and phasing which occurred during and after the heat/cool cycle. "Good" is defined as little or no precipitation or phasing resulting after the heat/cool cycle. "Poor" is defined as significant precipitation or phasing resulting after the heat/cool cycle. The calculated FLB number is presented for each fluorochemical.

Results are presented in TABLE 2

TABLE 2

| Ex. | Fluorochemical | FLB Value | Compatibility |
|---|---|---|---|
| 15 | 2MeFOSE/AZA | 13.3 | Poor |
| 16 | 2MeFOSE/OSA | 12.8 | Poor |
| 17 | 2MeFOSE/DDSA | 12.3 | Poor |
| 18 | 2MeFOSE/ODSA | 11.6 | Poor |
| 19 | FC Adipate Ester | 11.0 | Poor |
| 20 | 2MeFOSE/Dimer Ester | 10.0 | Good |
| 21 | EtFOSE Stearate | 9.8 | Good |

TABLE 2-continued

| Ex. | Fluorochemical | FLB Value | Compatibility |
|---|---|---|---|
| 22 | FC/HC Urethane C | 8.4 | Good |
| 23 | FC/HC Urethane B | 6.5 | Good |
| 24 | FC/HC Urethane A | 5.6 | Good |

The data in TABLE 2 show that fluorochemicals having an FLB value of less than 11 were compatible with PEG400DS and were thus useful as compatible fluorochemicals. Those fluorochemicals having an FLB value of 11 or greater were incompatible with the PEG400DS and, though inherently repellent, would not be useful as the sole fluorochemical in a shelf-stable formulation to impart oil- and water-repellency to the neat spin finish.

EXAMPLES 25–38

In this series of experiments, combinations of compatible fluorochemicals (FLB≦11) and repellent fluorochemicals (FLB>11) were evaluated for compatibility with PEG400DS (EMEREST™ 2712 surfactant), at total levels of 10% or 15% solids, in a neat spin finish formulation. The mixture was homogenized by heating to 120–130° C. for ½ hour with occasional agitation, the compatibility of the liquid mixture was noted, then the mixture was allowed to cool to room temperature. One additional heat/cool cycle was then run, and the compatibility of the mixture was again noted. Weighted average FLB values (i.e., <FLB> values) were calculated for each mixture.

Results are presented in TABLE 3.

The data in TABLE 3 show that, with the mixtures of compatible fluorochemicals and repellent fluorochemicals in PEG400DS , clear, miscible neat spin finish formulations occurred when molten when the weighted FLB values were less than 11.

EXAMPLES 39–44

In this series of experiments, compatible fluorochemicals were incorporated at 10% by weight into various hydrocarbon surfactants, the resulting mixtures were evaluated as neat spin finishes for polypropylene fibers, the treated fibers were tufted into a carpet, and the carpet was evaluated for water- and oil-repellency.

In EXAMPLES 39–41, FC/HC Urethanes A, B and C respectively were dissolved at 10% (w/w) in PEG400DS (EMEREST™ 2712 surfactant) by heating the mixture at 120–130° C. for about ½ hour and occasionally agitating. The clarity of the mixture when molten was noted. Using the Fiber Drawing and Texturizing Procedure, each spin finish was applied at about 0.75% SOF to polypropylene fiber. The coefficient of friction for the fiber was measured immediately after the spin finish application. The treated and texturized fiber was then tufted into a carpet using the Carpet Tufting Procedure, and water and oil repellency were measured for the tufted carpet.

In EXAMPLE 42, the same procedures and test methods were followed as in EXAMPLES 39–41, except that 15% (w/w) of FC/HC Urethane A was dissolved in stearyldiethanolamine amide (STDEA).

In EXAMPLE 43, the same procedures and test methods were followed as in EXAMPLES 39–41, except that 15% (w/w) of FC/HC Urethane A was dissolved in glyceryl monostearate (GMS) by heating at 120–130° C. for about ½ hour and occasionally agitating

TABLE 3

| Ex. | Compatible Fluorochemical % | Repellent Fluorochemical % | <FLB> Value | Compatibility |
|---|---|---|---|---|
| 25 | 2MeFOSE/Dimer Ester, 10% | 2FC-Telomer/ AzA, 5% | 11.5 | not miscible, stratified after heat/cool cycle |
| 26 | 2MeFOSE/Dimer Ester, 8.75% | 2MeFOSE/OSA, 6.25% | 11.1 | cloudy, stratified after heat/cool cycle |
| 27 | 2MeFOSE/Dimer Ester, 10% | 2MeFOSE/AzA, 5% | 11.1 | miscible, clear when heated to 130° C. |
| 28 | 2MeFOSE/Dimer Ester, 10% | 2MeFOSE/OSA, | 11.0 | almost clear |
| 29 | 2MeFOSE/Dimer Ester, 8.75% | 2MeFOSE/ DDSA, 6.25% | 10.9 | almost clear |
| 30 | 2MeFOSE/Dimer Ester, 10% | 2MeFOSE/ DDSA, 5% | 10.8 | almost clear |
| 31 | EtFOSE Stearate, 10% | 2MeFOSE/OSA, | 10.8 | clear |
| 32 | 2MeFOSE/Dimer Ester, 10% | 2MeFOSE/ ODSA, 5% | 10.6 | almost clear |
| 33 | EtFOSE Stearate, 10% | 2MeFOSE/ DDSA,5% | 10.6 | clear |
| 34 | EtFOSE Stearate, 10% | 2MeFOSE/ ODSA, 5% | 10.4 | clear with slight sediment |
| 35 | 2MeFOSE/Dimer Ester, 8% | FC Adipate Ester, 7% | 10.4 | miscible |
| 36 | 2MeFOSE/Dimer Ester, 10% | FC Adipate Ester, 5% | 10.3 | miscible |
| 37 | EtFOSE Stearate, 10% | FC Adipate Ester, 5% | 10.2 | clear, miscible |
| 38 | EtFOSE Stearate, 10% | — | 9.8 | clear, miscible |

In EXAMPLE 44, the same procedures and test methods were followed as in EXAMPLES 39–41, except that the compatible fluorochemical was omitted (i.e., the PEG400DS was run alone).

Results are presented in TABLE 4

TABLE 4

| Ex. | Spin Finish Comp. | Clarity | COF | Water Rep. | Oil Rep. |
|---|---|---|---|---|---|
| 39 | PEG400DS + FC/HC Urethane A | Clear | 0.28 | 3 | 2 |
| 40 | PEG400DS + FC/HC Urethane B | Clear | 0.28 | 2 | 2 |
| 41 | PEG400DS + FC/HC Urethane C | Clear | 0.28 | 1 | F |
| 42 | STDEA + FC/HC Urethane A | Clear | 0.30 | 6 | 5 |
| 43 | GMS + FC/HC Urethane A | Clear | 0.30 | 6 | 4 |
| 44 | PEG400DS | Clear | 0.22 | F | F |

The data in TABLE 2 show that the compatible fluorochemicals all formed clear solutions in the molten hydrocarbon surfactant. The resulting spin finishes all imparted good coefficient of friction to the fiber as well as generally good water and oil repellency to the tufted carpet.

EXAMPLES 45–52

In this series of experiments, a number of repellent fluorochemicals and compatible fluorochemicals were each incorporated into PEG400DS (EMEREST™ 2712 surfactant), the resulting mixtures were evaluated as neat spin finishes for polypropylene fibers, the treated fibers were tufted into a carpet, and the carpet was evaluated for water-and oil-repellency. The same procedures and test methods were followed as used in EXAMPLES 39–41.

In EXAMPLES 45–46, 10% or 5% respectively of FC Dimer Ester compatibilizer and 5% or 7% respectively of FC Adipate Ester repellent were incorporated into the PEG400DS.

In EXAMPLES 47–50, the same procedures and test methods were followed as in EXAMPLES 39–41, except that 10% of FC Dimer Ester compatibilizer and 5% of a MeFOSE/alkylsuccinic anhydride ($C_{18}$, $C_{12}$ or $C_8$) or MeFOSE/AZA repellent, respectively, were used as the fluorochemical additives.

In EXAMPLE 51, the same procedures and test methods were followed as in EXAMPLES 39–41, except that 10% of EtFOSE Stearate compatibilizer and 5% of FC Adipate Ester repellent were used as the fluorochemical additives.

In EXAMPLE 52, the same procedures and test methods were followed as in EXAMPLES 39–41, except that 5% of EtFOSE Stearate compatibilizer and 5% of FC/AZA repellent were used as the fluorochemical additives.

Results are presented in TABLE 5.

TABLE 5

| Ex. | FC Additives | Clarity | COF | Water Rep. | Oil Rep. |
|---|---|---|---|---|---|
| 45 | 10% FC Dimer Acid + 5% FC Adipate Ester | Clear | 0.24 | 4 | 2 |
| 46 | 8% FC Dimer Acid + 7% FC Adipate Ester | Clear | 0.24 | 3 | 1 |
| 47 | 10% FC Dimer Acid + 5% 2MeFOSE/ODSA | Clear | 0.24 | 3 | 1 |

TABLE 5-continued

| Ex. | FC Additives | Clarity | COF | Water Rep. | Oil Rep. |
|---|---|---|---|---|---|
| 48 | 10% FC Dimer Acid + 5% 2MeFOSE/DDSA | Clear | 0.24 | 3 | 1.5 |
| 49 | 10% FC Dimer Acid + 5% 2MeFOSE/OSA | Clear | 0.23 | 3 | 1.5 |
| 50 | 10% FC Dimer Acid + 5% 2MeFOSE/AZA | Clear | 0.24 | 2 | 1 |
| 51 | 10% EtFOSE Stearate + 5% FC Adipate Ester | Clear | 0.23 | 2 | 0 |
| 52 | 10% EtFOSE Stearate + 5% 2MeFOSE/AZA | Clear | 0.23 | 3 | 2 |

The data in TABLE 3 show that in each example, a combination of good fiber lubricity and carpet water-and oil-repellency achieved with the combination of the repellent fluorochemical and compatible fluorochemical in the PEG400DS neat spin finish composition.

EXAMPLES 53–55

These experiments were run to show that commercially available fluorochemical emulsions, rather than neat fluorochemicals, can be added to hydrocarbon surfactants to formulate useful spin finishes.

In EXAMPLES 53 and 54, respectively, 3M™ FC-5101 Protective Chemical and 3M™ FC-5102 Protective Chemical (repellent fluorochemicals, each approximately 20% solids in water, available from 3M Company) were each heated to 80° C. and each was added at 20% commodity (4% solids, 16% water) to neat PEG400DS (EMEREST™ 2712 surfactant). The resulting mixtures were heated and socially blended to achieve a homogeneous dispersion which was cloudy in each case. The resultant "water-in-oil" dispersion were allowed to solidify while cooling to room temperature. The resulting waxes were re-melted and were quickly applied to polypropylene fiber using the Fiber Spinning and Texturizing Procedure, with no problems noted in the fiber line. Coefficient of friction was measured for each treated fiber prior to texturization. Each texturized fiber was woven into a carpet using the Carpet Tufting Procedure, and water- and oil-repellency of each carpet were measured.

In EXAMPLE 55, neat PEG400DS was run as the spin finish without any fluorochemical emulsion added.

Results are presented in TABLE 6.

TABLE 6

| Ex. | FC Additives | Clarity | % FC | % Water | COF | Water Rep. | Oil Rep. |
|---|---|---|---|---|---|---|---|
| 53 | FC-5101 | Cloudy | 4.0 | 16.0 | 0.23 | F | 3 |
| 54 | FC-5102 | Cloudy | 4.0 | 16.0 | 0.23 | 4 | 2 |
| 55 | None | Clear | — | — | 0.20 | F | F |

The data in Table 6 show that both of the high solids spin finish compositions imparted oil-and/or water-repellency to the carpet, even though the spin finishes were cloudy and did not remain homogeneous when molten. Both ran well during the fiber-making procedure, showing little or no deposits on the godets.

EXAMPLES 56–61

A study was made of water solubility in molten polyethylene glycol distearates of varying HLB values to determine how much water could be added before a cloudy or turbid mixture resulted. A clear spin finish is advantageous from a product stability/compatibility consideration.

For each polyethylene glycol distearate (PEG100DS, PEG200DS, PEG300DS, PEG400DS, PEG600DS and PEG1000DS), 100 g was weighed into a 250 mL beaker The beaker and its contents were placed onto a heated stirrer, a magnetic bar was dropped in, and the contents were heated to 60–65° C. until molten while stirring at a moderate speed. Deionized water was added using a burette (swiftly to minimize water evaporation) until the molten mixture remained cloudy for at least 15 seconds after water addition.

Results, presented in TABLE 7, show the percent by weight of water required to cause a permanent cloudiness in the polyethylene glycol distearate. Also presented in TABLE 7 is the approximate HLB value calculated for each distearate.

TABLE 7

| Example | HC Surfactant | HLB | % Water Until Turbid |
|---|---|---|---|
| 56 | PEG100DS | 2.8 | <0.1 |
| 57 | PEG200DS | 4.8 | <0.1 |
| 58 | PEG300DS | 6.5 | 0.6 |
| 59 | PEG400DS | 8.7 | 2 |
| 60 | PEG600DS | 10.4 | 5 |
| 61 | PEG1000DS | 12.9 | miscible (clear gel) |

The data in TABLE 7 show that the amount of water which can be tolerated in an essentially neat, homogeneous, one-phase, shelf-stable spin finish composition increases rather dramatically with increasing HLB value of the surfactant.

Samples at or below the water tolerance levels shown in TABLE 7 and samples containing twice the water tolerance levels were sealed in vials and were placed in a 70° C. oven overnight. Examination of the samples next morning showed that those samples having water at or below the tolerance level were unchanged (i.e., they appeared clear or as one cloudy phase, the same as they had appeared before the oven exposure). However, the samples prepared with water at twice the water tolerance level had separated into two or three phases, indicating product instability.

EXAMPLES 62–67

This series of experiments was run to show that carpet repellency to water and oil can alternatively be achieved by incorporating fluorochemical into the fiber polymer prior to fiber and carpet construction (in contrast to incorporating the fluorochemical additive into the neat hydrocarbon surfactant spin finish), followed by applying a fluorine-free, hydrocarbon surfactant neat spin finish composition of this invention to the fluorochemical-containing fiber.

In EXAMPLE 62, Scotchban™ FC-1801 Protector, a fluorochemical oxazolidinone polymer melt additive repellent available from 3M Company, was pre-compounded at 15% concentration in 35 melt-flow index polypropylene using a twin screw extruder. This 15% pre-concentrate was then mixed at 1.0% concentration with fiber-grade polypropylene having a melt-flow index of 18 at a level to give a 0.15% FC-1801 concentration in polypropylene. The resulting composition was melt-spun using the Fiber Spinning Procedure. During spinning, molten neat PEG400DS (EMEREST™ 2712 surfactant) was applied as a spin finish to the fiber at an add-on level of 0.8% SOF Coefficient of friction was measured for the treated fiber. Using the Carpet Tufting Procedure, a carpet was woven from the fiber, and the resulting carpet was tested for water-and oil-repellency.

EXAMPLE 63, the same procedures and test methods were followed as in EXAMPLE 62, except that the level of FC-1801 in the polypropylene used to spin the fiber was increased to 0.5% (by mixing 3.3 times the amount of the 15% (w/w)FC-1801/polypropylene pre-compound with the fiber-grade polypropylene).

EXAMPLE 64, the same procedures and test methods were followed as in EXAMPLE 62, except that Scotchban™ FC-1808 Protector (available from 3M Company), a fluorochemical ester polymer melt additive repellent, was substituted for Scotchban™ FC-1801 Protector. The level of FC-1808 in the polypropylene used to pin the fiber was 0.15%.

In EXAMPLE 65, the same procedures and test methods were followed as in EXAMPLE 64, except that the level of FC-1808 in the polypropylene used to spin the fiber was increased to 0.5%.

In EXAMPLE 66, the same procedures and test methods were followed as in EXAMPLE 64, except that the level of FC-1808 in the polypropylene used to spin the fiber was increased to 1.0%.

In EXAMPLE 67, the same procedures and test methods were followed as in EXAMPLE 62, except that no fluorochemical polymer melt additive was incorporated into the polypropylene prior to spinning the fiber.

Results are presented in TABLE 8.

TABLE 8

| Ex. | FC Polym. Melt. Add. | COF | Water Rep. | Oil Rep. |
|---|---|---|---|---|
| 62 | 0.15% FC-1801 | 0.20 | 6 | 3 |
| 63 | 0.5% FC-1801 | 0.21 | 9 | 3 |
| 64 | 0.15% FC-1808 | 0.21 | 5 | 2 |
| 65 | 0.5% FC-1808 | 0.22 | 8 | 3 |
| 66 | 1.0% FC-1808 | 0.21 | 8 | 3 |
| 67 | None | 0.20 | 1 | F |

The data in TABLE 8 show that "fluorochemical-class" water-and oil -repellency can be imparted to the fiber even when a fluorine-free solid spin finish is applied to the surface of the fiber.

The preceding description of the present invention is merely illustrative, and is not intended to be limiting. Therefore, the scope of the present invention should be construed solely by reference to the appended claims.

What is claimed is:

1. A method for drawing fiber, comprising the steps of:

providing a fiber;

applying to the fiber a spin finish composition comprising a nonionic hydrocarbon surfactant having a <HLB> value within the range of 2 to about 13, thereby forming a treated fiber; and drawing the treated fiber;

wherein the spin finish composition is applied at a weight percent of less than about 4% solids on fiber and has a solids content of at least about 70% by weight, based on the total weight of the spin finish composition, and wherein the solids content of the spin finish has a coefficient of friction of less than about 0.35 and a melting point within the range of about 25° C. to about 140° C.

2. The method of claim 1, wherein said spin finish composition contains an amount of solids within the range of about 70% to about 100% by weight, based on the total weight of the spin finish composition, and an amount of solvent within the range of about 0% to about 30% by weight, based on the total weight of the spin finish composition.

3. The method of claim 2, wherein said solvent is water.

4. The method of claim 2, wherein said spin finish composition is applied essentially neat.

5. The method of claim 1, wherein said spin finish composition has a melting point within the range of about 30° C. to about 60° C.

6. The method of claim 1, wherein the spin finish composition is applied at a weight percent of greater than about 0.2% solids on fiber.

7. The method of claim 1, wherein the spin finish composition is applied at a weight percent within the range of about 0.5% to about 2% solids on fiber.

8. The method of claim 1, wherein the spin finish composition is applied at a weight percent within the range of about 0.75% to about 1.4% solids on fiber.

9. The method of claim 1, wherein the spin finish composition has a <HLB> value within the range of 3 to about 12.

10. The method of claim 1, wherein the spin finish composition h as a <HLB> value within the range of 5 to about 8.5.

11. The method of claim 1, wherein the hydrocarbon surfactant is a polyoxyethylene.

12. The method of claim 11, wherein the polyoxyethylene is a stearic acid ester of polyethylene glycol.

13. The method of claim 12, wherein the hydrocarbon surfactant is selected from the group consisting of polyethylene glycol 400 distearate, polyethylene glycol 300 distearate, and polyethylene glycol 200 distearate.

14. The method of claim 11, wherein the hydrocarbon surfactant is polyoxyethylene 600 distearamide.

15. The method of claim 11, wherein the hydrocarbon surfactant is glycerol monostearate.

16. A method for treating fiber, comprising the steps of:

providing a fiber; and applying a primary spin finish to the fiber, thereby forming a treated fiber;

wherein the spin finish comprises a nonionic hydrocarbon, surfactant having a <HLB> value within the range of 2 to about 13, wherein the spin finish composition is applied at a weight percent of less than about 4% solids on fiber and has a solids content of at least about 70% by weight, based on the total weight of the spin finish composition, and wherein the solids content of the spin finish has a coefficient of friction of less than about 0.35 and a melting point within the range of about 25° C. to about 140° C.

17. A method for drawing fiber, comprising the steps of:

providing a fiber;

applying to the fiber a spin finish composition comprising a nonionic polyoxyalkylene surfactant having a <HLB> value within the range of 2 to about 13, thereby forming a treated fiber, and drawing the treated fiber;

wherein the spin finish composition is applied at a weight percent of less than about 4% solids on fiber and has a solids content of at least about 70% by weight, based on the total weight of the spin finish composition, and wherein the solids content of the spin finish has a coefficient of friction of less than about 0.35 and a melting point within the range of about 25° C. to about 140° C.

18. A method for making a carpet, comprising the steps of:

providing polypropylene fiber;

applying to the fiber a molten neat spin finish composition comprising a material selection from the group consisting of (i) fatty acid esters, (ii) fatty alcohols, (iii) alkyl diesters of polyethylene glycols, wherein the alkyl diesters have polyethylene glycol segments with molecular weights within the range of about 100 to 600 g/mol, (iv) stearyl monoesters of polyethylene glycols, (v) alkyl esters of polytetrahydrofuran glycol, (vi) alkyl amides of polyoxyethylene diamine, and (vii) alkyl urethanes of methoxypolyethylene glycol; and weaving the fiber into a carpet.

19. The method of claim 18, wherein the spin finish composition comprising a fatty acid ester.

20. The method of claim 18, wherein the spin finish composition comprising a material selection from the group consisting of alkyl diesters of polyethylene glycols which have polyethylene glycol segments with molecular weights within the range of about 100 to 600 g/mol.

21. The method of claim 18, wherein the spin finish composition has a melting point within the range of about 30° C. to about 60° c.

22. The method of claim 18, wherein the spin finish composition is applied at a weight percent within the range of about 0.2% to about 4% solids on fiber.

23. The method of claim 18, wherein the spin finish composition is applied at a weight percent within the range of about 0.5% to about 2% solids on fiber.

24. The method of claim 18, wherein the spin finish composition is applied at a weight percent within the range of about 0.75% to about 1.4% solids on fiber.

25. The method of claim 18, wherein the spit finish composition has a <HLB> value within the range of 3 to about 12.

26. The method of claim 18, wherein the spin finish composition has a <HLB> value within the range of 5 to about 8.5.

27. The method of claim 18, wherein the spin finish composition comprises an alkyl ester of polyoxyethylene diamine.

28. The method of claim 18, wherein the spin finish composition comprises an alkyl diester of polyethylene glycol selected from the group consisting of polyethylene glycol 400 distearate, polyethylene glycol 300 distearate, and polyethylene glycol 200 distearate.

29. The method of claim 18, wherein the spin finish composition comprises polyoxyethylene 600 distearamide.

30. The method of claim 18, wherein the spin finish composition comprises a material selected from the group consisting of:

PEG400DS, PEG200DS, PTHF650S, ED600DSA, PEG2000DB, MPEG750MS, MPEGMSU, and ETFOSE stearate.

31. The method of claim 18, wherein the spin finish composition comprises a material selected from the group consisting of:

PEG400DS and PEG200DS.

32. The method of claim 18, wherein the spin finish composition comprises PTHF650S.

33. The method of claim 18, wherein the spin finish composition comprises ED600DSA.

34. The method of claim 18, wherein the spin finish composition comprises PEG2000DB.

35. The method of claim 18, wherein the spin finish composition comprises MPEG750MS.

36. The method of claim 18, wherein the spin finish composition comprises MPEGMSU.

37. The method of claim 18, wherein the spin finish composition comprises ETFOSE stearate.

38. The method of claim 18, wherein the spin finish composition is applied as a primary spin finish.

39. An method for making an article out of polypropylene fiber, comprising the steps of:

providing polypropylene fiber;

applying to the fiber a molten neat spin finish composition comprising a material selected from the group consisting of (i) fatty acid esters, (ii) fatty alcohols, (iii) alkyl diesters of polyethylene glycol, wherein the alkyl diesters have polyethylene glycol segments with molecular weights within the range of about 1.00 to 600 g/mol, (iv) stearyl monoesters of polyethylene glycols, (v) alkyl esters of polytetrahydrofuran glycol, (vi) alkyl amides of polyoxyethylene diamine, and (vii) alkyl urethanes of methoxypolyethylene glycol; and assembling the fiber into an article;

wherein the molten spin finish composition is applied at an amount within the range of about 0.5% to about 1.9% solids on fiber.

40. The method of claim 39, wherein the article is a carpet.

41. The method of claim 39, wherein the spin finish composition comprises a fatty acid ester.

42. The method of claim 39, wherein the spin finish composition comprises a material selected from the group consisting of alkyl diesters of polyethylene glycols which have polyethylene glycol segments with molecular weights within the range of about 100 to 600 g/mol.

43. The method of claim 39, wherein the spin finish composition has a melting point within the range of about 30° C. to about 60° C.

44. The method of claim 39, wherein the spin finish composition is applied at a weight percent within the range of about 0.75% to about 1.4% solids on fiber.

45. The method of claim 39, wherein the spin finish composition has a <HLB> value within the range of 3 to about 12.

46. The method of claim 39, wherein the spin finish composition has a <HLB> value within the range of 5 to about 8.5.

47. The method of claim 39, wherein the spin finish composition comprises an alkyl ester of polyoxyethylene diamine.

48. The method of claim 39, wherein the spin finish composition comprises an alkyl diester of polyethylene glycol selected from the group consisting of polyethylene glycol 400 distearate, polyethylene glycol 300 distearate, and polyethylene glycol 200 distearate.

49. The method of claim 39, wherein the spin finish composition comprises polyoxyethylene 600 distearamide.

50. The method of claim 39, wherein said spin finish composition contains an amount of solids within the range of about 70% to about 100% by weight, based on the total weight of the spin finish composition, and an amount of solvent within the range of about 0% to about 30% by weight, based on the total weight of the spin finish composition.

51. The method of claim 50, wherein said solvent is water.

52. The method of claim 39, wherein said spin finish composition is applied essentially neat.

53. The method of claim 39, wherein the spin finish composition comprises a material selected from the group consisting of:

PEG400DS, PEG200DS, PTHF650S, ED600DSA, PEG2000DB, MPEG750MS, MPEGMSU, and ETFOSE stearate.

54. The method of claim 39, wherein the spin finish composition comprises PTHF650S.

55. The method of claim 39, wherein the spin finish composition comprises ED600DSA.

56. The method of claim 39, wherein the spin finish composition comprises PEG2000DB.

57. The method of claim 39, wherein the spin finish composition comprises MPEG750MS.

58. The method of claim 39, wherein the spin finish composition comprises MPEGMSU.

59. The method of claim 39, wherein the spin finish composition comprises ETFOSE stearate.

60. The method of claim 39, wherein the fiber is drawn after the spin finish is applied.

61. The method of claim 39, wherein the spin finish composition is applied as a primary spin finish.

62. The method of claim 16, wherein said spin finish composition has a melting point within the range of about 30° C. to about 60° C.

63. The method of claim 16, wherein, the spin finish composition is applied at a weight percent within the range of about 0.2% to about 4% solids on fiber.

64. The method of claim 16, wherein the spin finish composition is applied at a weight percent within the range of about 0.5% to about 2% solids on fiber.

65. The method of claim 16, wherein the spin finish composition is applied at a weight percent within the range of about 0.75% to about 1.4% solids on fiber.

66. The method of claim 16, wherein the spin finish composition has a <HLB> value within the range of 3 to about 12.

67. The method of claim 16, wherein the spin finish composition has a <HLB> value within the range of 5 to about 8.5.

68. The method of claim 16, wherein the hydrocarbon surfactant is a polyoxyethylene.

69. The method of claim 16, wherein the hydrocarbon surfactant is a stearic acid ester of polyethylene glycol.

70. The method of claim 16, wherein the hydrocarbon surfactant is selected from the group consisting of polyethylene glycol 400 distearate, polyethylene glycol 300 distearate, and polyethylene glycol 200 distearate.

71. The method of claim 16, wherein the hydrocarbon surfactant is polyoxyethylene 600 distearamide.

72. The method of claim 16, wherein the hydrocarbon surfactant is glycerol monostearate.

73. The method of claim 16, further comprising the step of drawing the treated fiber.

74. The method of claim 17, wherein said spin finish composition has a melting point within the range of about 30° C. to about 60° C.

75. The method of claim 17, wherein the spin finish composition is applied at a weight percent within the range of about 0.2% to about 4% solids on fiber.

76. The method of claim 17, wherein the spin finish composition is applied at a weight percent within the range of about 0.5% to about 2% solids on fiber.

77. The method of claim 17, wherein the spin finish composition is applied at a weight percent within the range of about 0.75% to about 1.4% solids on fiber.

78. The method of claim 17, wherein the spin finish composition has a <HLB> value within the range of 3 to about 12.

79. The method of claim 17, wherein the spin finish composition has a <HLB> value within the range of 5 to about 8.5.

80. The method of claim 17, wherein the surfactant is a polyoxyethylene.

81. The method of claim 17, wherein the surfactant is a stearic acid ester of polyethylene glycol.

82. The method of claim 17, wherein the surfactant is selected from the group consisting of polyethylene glycol 400 distearate, polyethylene glycol 300 distearate, and polyethylene glycol 200 distearate.

83. The method of claim 17, wherein the surfactant is polyoxyethylene 600 distearamide.

84. The method of claim 17, further comprising the step of:

weaving the drawn fiber into carpet.

85. The method of claim 17, wherein the spin finish composition comprises glycerol monostearate.

86. The method of claim 1, wherein the spin finish composition is applied as a primary spin finish.

* * * * *

UNITED STATES PATENT AND TRADEMARK OFFICE

CERTIFICATE OF CORRECTION

PATENT NO. : 6,077,468
DATED : June 20, 2000
INVENTOR(S) : Chetan P. Jariwala, Edward R. Hauser, James E. Lockridge, Irvin F. Dunsmore, Malcolm B. Burleigh, and Nicole L. Franchina It is certified that error appears in the above-identified patent and that said Letters Patent is hereby corrected as shown below:

Column 1,
Line 13, "natural-containing" should read -- natural-ocurring --;

Column 2,
Line 57, "monopelargooiate" should read -- monopelargonate --;

Column 14,
Line 64, "184 (0.33 eq)" should read -- 184 g (0.33 eq) --;
Line 67, "DESMODURIM" should read -- DESMODUR --;

Column 17,
Line 62, "fine" should read -- line --;

Column 18,
Line 3, "drawing, of" should read -- drawing of --;

Column 19,
Line 5, "one cycles equals" should read -- one cycle equals --;
Line 24, "(Usually" should read -- (usually --;

Column 21,
Line 35, "measured" should read -- measured. --;

Column 23, Table 3,
Ex. 28 and 31, third column, "2MeFOSE/OSA," should read
-- 2MeFOSE/OSA, 5% --;

Column 26,
Line 17, "that in" should read -- that, in --;
Line 34, "socially" should read -- sonically --;

Column 27,
Line 66, "SOF Coefficient" should read -- SOF. Coefficient --;

Column 28,
Line 14, "pin" should read -- spin --;

UNITED STATES PATENT AND TRADEMARK OFFICE

CERTIFICATE OF CORRECTION

PATENT NO. : 6,077,468
DATED : June 20, 2000
INVENTOR(S) : Chetan P. Jariwala, Edward R. Hauser, James E. Lockridge, Irvin F. Dunsmore, Malcolm B. Burleigh, and Nicole L. Franchina It is certified that error appears in the above-identified patent and that said Letters Patent is hereby corrected as shown below:

Column 29,
Line 22, "h as" should read -- has --;
Line 39, "hydrocarbon," should read -- hydrocarbon --;
Line 66, "selection" should read -- selected --;

Column 30,
Line 16, "comprising" should read -- comprises --;
Line 16, "selection" should read -- selected --;
Line 22, "60° c." should read -- 60° C. --;
Line 32, "spit" should read -- spin --;

Column 31,
Line 5, "An method" should read -- A method --; and
Line 15, "1.00" should read -- 100 --.

Signed and Sealed this

Twelfth Day of February, 2002

*Attest:*

*Attesting Officer*

JAMES E. ROGAN
*Director of the United States Patent and Trademark Office*